US006638417B2

(12) United States Patent
Ishida et al.

(10) Patent No.: US 6,638,417 B2
(45) Date of Patent: Oct. 28, 2003

(54) TRACTION DRIVE FLUID

(75) Inventors: Noboru Ishida, Yokohama (JP); Shinichi Shirahama, Yokohama (JP); Tetsuo Okawa, Tokyo (JP); Shigeki Matsui, Yokohama (JP)

(73) Assignee: Nippon Mitsubishi Oil Corporation, Tokyo (JP)

( * ) Notice: Subject to any disclaimer, the term of this patent is extended or adjusted under 35 U.S.C. 154(b) by 0 days.

(21) Appl. No.: 09/737,292

(22) Filed: Dec. 15, 2000

(65) Prior Publication Data

US 2001/0010293 A1 Aug. 2, 2001

Related U.S. Application Data

(63) Continuation of application No. PCT/JP00/02460, filed on Apr. 14, 2000.

(30) Foreign Application Priority Data

Apr. 16, 1999 (JP) ..... 11-109842
Jul. 29, 1999 (JP) ..... 11-215502
Aug. 19, 1999 (JP) ..... 11-232661

(51) Int. Cl.[7] ..... C07C 7/20; C10M 105/02; C10L 1/04

(52) U.S. Cl. ..... 208/19; 208/18; 585/2; 585/3; 508/462; 508/484; 508/486; 508/499

(58) Field of Search ..... 208/19, 18; 585/2, 585/3; 508/462, 484, 496, 499

(56) References Cited

U.S. PATENT DOCUMENTS 3,440,894 A 4/1969 Hammann et al.
3,925,217 A 12/1975 Green et al.
4,371,726 A 2/1983 Horita et al.
6,242,393 B1 * 6/2001 Ishida et al. ..... 508/462

FOREIGN PATENT DOCUMENTS

| | | |
|---|---|---|
| EP | 0 949 319 A2 | 10/1999 |
| JP | 47-35763 B | 9/1972 |
| JP | 59-129293 A | 7/1984 |
| JP | 61-188495 A | 8/1986 |
| JP | 5-105890 A | 4/1993 |

* cited by examiner

*Primary Examiner*—Walter D. Griffin
*Assistant Examiner*—Tam Nguyen
(74) *Attorney, Agent, or Firm*—Akin Gump Strauss Hauer & Feld, L.L.P.

(57) ABSTRACT

A traction drive fluid is provided containing a naphthenic compound represented by the formula:

(1)

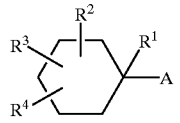

wherein $R^1$ is an alkyl group having 1 to 8 carbon atoms, $R^2$ through $R^4$ are each independently hydrogen or an alkyl group having 1 to 8 carbon atoms, and A is a naphthenic hydrocarbon group, a saturated polycyclic hydrocarbon group, a naphthenic ester group, or a naphthenic carbonate group.

8 Claims, No Drawings

TRACTION DRIVE FLUID

CROSS-REFERENCE TO RELATED APPLICATION

This application is a continuation of International Application No. PCT/JP00/02460 filed Apr. 14, 2000 the disclosure of which is incorporated herein by reference.

BACKGROUND OF THE INVENTION

1. Technical Field

This invention relates to traction drive fluids. The invention relates particularly to traction drive fluids which can be used not only in driving force transmitting mechanisms but also in hydraulic pressure controlling mechanisms and friction characteristics controlling mechanism using a wet-type clutch, and more particularly to traction drive fluids which are suitably used in continuously variable transmissions of traction drive type of automobiles.

2. Background Art

In the field of machinery for industrial use, traction drive fluids have been used in force transmitting device of traction drive type which form the thin film of the traction drive fluid and transmit power via the film. Such traction drive fluids have been demanded to be high in traction drive coefficient which indicates the capability of transmitting driving force.

Recently, the research and development of traction drive fluids have been progressed to utilize them in the continuously variable transmissions of an automobile. When used for an automobile, a traction drive fluid is used not only in the driving force transmission mechanism but also in the hydraulic pressure controlling mechanism and the friction characteristic controlling mechanism of the wet-type clutch.

A lubricant known as automatic transmission fluid (ATF) has been used for the hydraulic controlling mechanism of the transmission and the friction characteristics controlling mechanism of the wet-type clutch of an automobile. It is a well-known fact that such ATF is required to be higher in a kinematic viscosity at elevated temperatures than a certain level and superior in flowability at low temperatures so as to perform the role of the hydraulic controlling mechanism. It is also well known that an ATF needs to be blended with additives having excellent friction characteristics, particularly anti-shudder characteristics for fulfilling the requirements in performing the role of the friction characteristics controlling mechanism, particularly the controlling mechanism having in addition slip controlling capability.

Therefore, when used in the continuous variable transmission of traction drive type of an automobile, a traction drive fluid is required to have its peculiar driving force transmitting capability but also capabilities as a fluid for the hydraulic controlling and friction characteristics controlling of a wet-type clutch, both of which are required for ATF.

SANTOTRAC is a commercially available traction drive fluid manufacture by Nippon Mitsubishi Oil Corporation and widely known to have an excellent power transmitting capability. However, traction drive fluids to be used in automobile continuously variable transmissions are required to have flowability at low temperatures and other performances, but such traction drive fluids have not been placed on the market yet.

In view of the current situations, the object of the present invention is to provide a traction drive fluid which is superior not only in power transmitting capability but also capabilities required as a fluid for a hydraulic controlling mechanism, i.e. flowability at low temperatures and capabilities required as a fluid for a wet type friction controlling mechanism.

SUMMARY OF THE INVENTION

Intensive research and efforts made to solve the foregoing problems resulted in the development of a traction drive fluid particularly suitable for use in continuous variable transmission of traction drive type of automobiles, more specifically a traction drive fluid which can be used not only in hydraulic controlling mechanism and friction characteristic controlling mechanism of wet clutches.

According to a first aspect of the present invention, there is provided a traction drive fluid comprising a naphthenic compound represented by the formula (1)

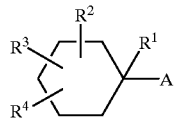

wherein $R^1$ is an alkyl group, which may have a naphthene ring, having 1 to 8 carbon atoms, $R^2$ through $R^4$ are each independently hydrogen or an alkyl group, which may have a naphthene ring, having 1 to 8 carbon atoms, and A is a naphthenic hydrocarbon group, a saturated polycyclic hydrocarbon group, a naphthenic ester group, and a naphthenic carbonate group.

According to a second aspect of the present invention, there is provided a traction drive fluid comprising a naphthenic compound represented by the formula (2)

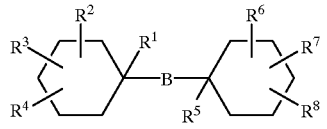

wherein $R^1$ is an alkyl group, which may have a naphthene ring, having 1 to 8 carbon atoms, $R^2$ through $R^8$ are each independently hydrogen or an alkyl group, which may have a naphthene ring, having 1 to 8 carbon atoms, and B is an alkylene group or indicates the form of bond between the two naphthenic rings selected from the group consisting of a direct bond, an ester bond, and a carbonate bond.

According to a third aspect of the present invention, there is provided a naphthenic compound represented by the formula (3)

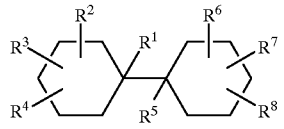

wherein $R^1$ is an alkyl group, which may have a naphthene ring, having 1 to 8 carbon atoms, $R^2$ through $R^8$ are each independently hydrogen or an alkyl group, which may have a naphthene ring, having 1 to 8 carbon atoms.

According to a forth aspect of the present invention, there is provided a naphthenic compound represented by the formula (4)

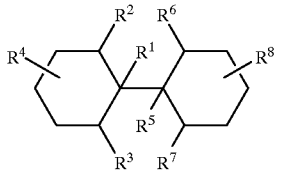

wherein $R^1$ is an alkyl group, which may have a naphthene ring, having 1 to 8 carbon atoms, $R^2$ through $R^8$ are each independently hydrogen or an alkyl group, which may have a naphthene ring, having 1 to 8 carbon atoms, and at least one of $R^2$, $R^3$, $R^6$ and $R^7$ is an alkyl group, which may have a naphthene ring, having 1 to 8 carbon atoms.

According to a fifth aspect of the present invention, there is provided a naphthenic compound represented by the formula (5)

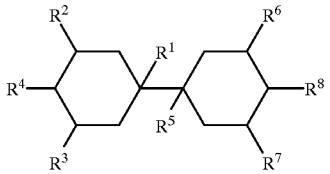

wherein $R^1$ is an alkyl group, which may have a naphthene ring, having 1 to 8 carbon atoms, $R^2$ through $R^8$ are each independently hydrogen or an alkyl group, which may have a naphthene ring, having 1 to 8 carbon atoms, and at least one of $R^2$, $R^3$, $R^6$ and $R^7$ is an alkyl group, which may have a naphthene ring, having 1 to 8 carbon atoms.

According to a sixth aspect of the present invention, there is provided a naphthenic compound represented by the formula (6)

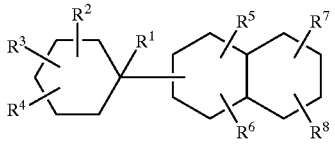

wherein $R^1$ is an alkyl group, which may have a naphthene ring, having 1 to 8 carbon atoms, $R^2$ through $R^8$ are each independently hydrogen or an alkyl group, which may have a naphthene ring, having 1 to 8 carbon atoms.

According to a seventh aspect of the present invention, there is provided a naphthenic compound represented by the formula (7)

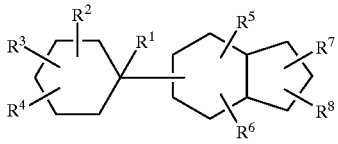

wherein $R^1$ is an alkyl group, which may have a naphthene ring, having 1 to 8 carbon atoms, $R^2$ through $R^8$ are each independently hydrogen or an alkyl group, which may have a naphthene ring, having 1 to 8 carbon atoms.

Furthermore, a traction drive fluid according to the present invention comprises a mixture of two or more compounds selected from the group consisting of naphthenic compounds represented by formulae (1), (2), (3), (4), (5), (6) and (7).

Still furthermore, a traction drive fluid according to the present invention comprises one or more members selected from the group consisting of naphthenic compounds represented by formulae (1), (2), (3), (4), (5), (6) and (7) and (A) at least one member selected from the group consisting of a mineral oil or a synthetic oil having a molecular weight of 150 to 800.

These traction drive fluids are preferably blended with (B) a viscosity index improver. The viscosity index improver (B) is preferably a ethylene-α-olefin copolymer with a number average molecular weight from 800 to 150,000 or a hydride thereof.

These traction drive fluids are preferably blended with (C) an ashless dispersant and (D) a phosphorus-containing additive.

These traction drive fluids are preferably blended with (E) a friction modifier having in its molecules an alkyl or alkenyl group having 6 to 30 carbon atoms but no hydrocarbon group having 31 or more carbon atoms.

These traction drive fluids are preferably blended with (F) a metallic detergent having a total base number of 20 to 450 mgKOH/g.

The blend of the above additives (A)–(F) with an inventive traction drive fluid results in enhanced low-temperature flowability, viscosity-temperature characteristics, wear resistance, oxidation stability, detergency, and friction characteristics.

The present invention is hereinafter described in detail.

An traction drive fluid according to the present invention is a naphthenic compound represented by the formula (1)

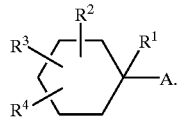

In formula (1), $R^1$ is an alkyl group, which may have a naphthene ring, having 1 to 8 carbon atoms, preferably an alkyl group having 1 to 4 carbon atoms, and more preferably methyl. $R^2$ through $R^4$ are each independently hydrogen or an alkyl group, which may have a naphthene ring, having 1 to 8 carbon atoms, preferably hydrogen or an alkyl group having 1 to 4 carbon atoms, and more preferably hydrogen or methyl. A is a naphthenic hydrocarbon group, a saturated polycyclic hydrocarbon group, a naphthenic ester group, and a naphthenic carbonate group.

Specific examples of the alkyl group, which may have a naphthene ring, having 1 to 8 carbon atoms are alkyl groups such as methyl, ethyl, propyl, butyl, pentyl, hexyl, heptyl, and octyl groups; (alkyl)cyclopentylalkyl groups whose alkyl group may be straight or branched and located at any position of the cyclopentyl group, such as cyclopentylmethyl, cyclopentylethyl, cyclopentylpropyl, methylcyclopentylmethyl, ethylcyclopentylmethyl, dimethylcyclopentylmethyl, and methylcyclopentylethyl groups; (alkyl)cyclohexylalkyl groups whose alkyl group may be straight or branched and located at any position of the cyclohexyl group, such as cyclohexylmethyl, cyclohexylethyl, and methylcyclohexylmethyl groups; and (alkyl)cycloheptylalkyl groups whose alkyl group may be straight or branched and located at any position of the cycloheptyl group, such as cycloheptylmethyl.

A in formula (1) has the following specific structures:

(i) naphthenic hydrocarbon group represented by the formulae:

(8)

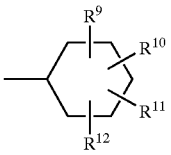

(9)

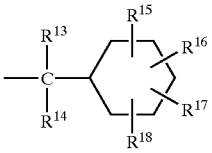

(10)

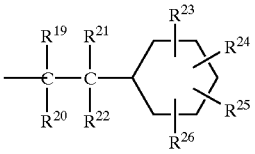

(11)

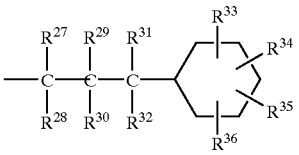

(12)

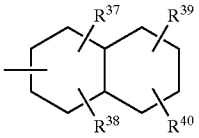

(13)

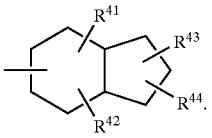

In formulae (8) through (13), $R^9$ through $R^{44}$ are each independently hydrogen or an alkyl group, which may have a naphthene ring, having 1 to 8 carbon atoms, preferably hydrogen or an alkyl group having 1 to 4 carbon atoms, and more preferably hydrogen or methyl.

Since no particular limitation is imposed on a method of synthesizing a naphthenic compound of formula (1) in which A is the above naphthenic hydrocarbon group (i), any suitably conventionally known method is employed. For instance, a naphthenic compound of formula (1) in which A is a naphthenic hydrocarbon group represented by formula (8) may be synthesized by the following condensation reaction or addition reaction.

Condensation or Addition Reaction

A cyclohexanol compound represented by formula (a-1) below or a cyclohexene compound represented by formula (a-2) below is reacted with an aromatic compound represented by formula (b-1) in the presence of an acid catalyst such as sulfuric acid, methanesulfonic acid, terra abla, and a nonaqueous ion-exchange resin such as Amberlite, at a temperature of 0 to 10° C. The resulting condensation or addition reaction product is subjected to hydrogenation of the benzene nucleus in the presence of a metallic hydrogenating catalyst such as nickel and platinum at a hydrogen pressure of 30 to 70 MPa and a temperature of 120 to 170° C., thereby obtaining a naphthenic compound of formula (1) wherein A is a naphthenic hydrocarbon group of formula (8):

(a-2)

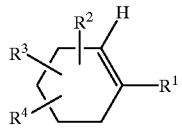

(b-1)

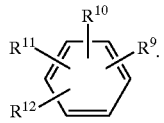

A naphthenic compound of formula (1) wherein A is a naphthenic hydrocarbon group represented by formula (12) may be synthesized by the following condensation or addition reaction.

Condensation or Addition Reaction

A cyclohexanol compound represented by formula (a-1) above or a cyclohexene compound represented by formula (a-2) above is reacted with a compound represented by formula (b-2) or (b-3) below in the presence of an acid catalyst such as sulfuric acid, methanesulfonic acid, terra abla, and a nonaqueous ion-exchange resin such as Amberlite, at a temperature of 0 to 10° C. The resulting condensation or addition reaction product is subjected to hydrogenation of the benzene nucleus in the presence of a metallic hydrogenating catalyst such as nickel and platinum at a hydrogen pressure of 30 to 70 MPa and a temperature of 120 to 170° C., thereby obtaining a naphthenic compound of formula (1) wherein A is a naphthenic hydrocarbon group of formula (12):

(b-3)

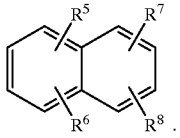

A naphthenic compound of formula (1) wherein A is a naphthenic hydrocarbon group represented by formula (13) may be synthesized by the following condensation or addition reaction.

Condensation or Addition Reaction

A cyclohexanol compound represented by formula (a-1) above or a cyclohexene compound represented by formula (a-2) above is reacted with a compound represented by formula (b-4) below in the presence of an acid catalyst such as sulfuric acid, methanesulfonic acid, terra abla, and a nonaqueous ion-exchange resin such as Amberlite, at a temperature of 0 to 10° C. The resulting condensation or addition reaction product is subjected to hydrogenation of the benzene nucleus in the presence of a metallic hydrogenating catalyst such as nickel and platinum at a hydrogen pressure of 30 to 70 MPa and a temperature of 120 to 170° C., thereby obtaining a naphthenic compound of formula (1)

wherein A is a naphthenic hydrocarbon group of formula (13):

(b-4)

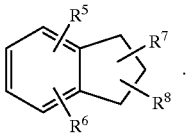

(ii) Saturated polycyclic hydrocarbon groups represented by formulae (14) and (15)

(14)

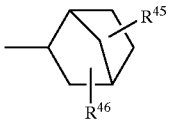

(15)

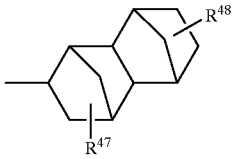

In formulae (14) and (15), $R^{45}$ through $R^{48}$ are each independently hydrogen or an alkyl group, which may have a naphthene ring, having 1 to 8 carbon atoms, preferably hydrogen or an alkyl group having 1 to 4 carbon atoms, and more preferably hydrogen or methyl.

(iii) Naphthenic ester groups represented by formulae (16) through (18)

(16)

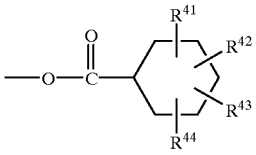

(17)

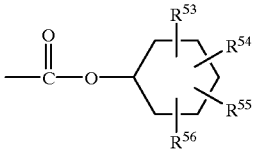

(18)

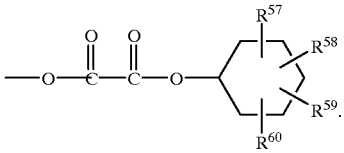

In formulae (16) through (18), $R^{49}$ through $R^{60}$ are each independently hydrogen or an alkyl group, which may have a naphthene ring, having 1 to 8 carbon atoms, preferably hydrogen or an alkyl group having 1 to 4 carbon atoms, and more preferably hydrogen or methyl.

Since no particular limitation is imposed on a method of synthesizing a naphthenic compound of formula (1) wherein A is a naphthenic ester group (iii), various conventional known methods may be employed. For instance, a naphthenic compound of formula (1) wherein A is a naphthenic ester group may be synthesized by the following esterification or ester interchange reaction.

Esterification Reaction

A cyclohexanol compound represented by formula (c) below and a cyclohexanecarboxylic acid compound represented by formula (d) below are subjected to an esterification reaction using a condensation catalyst such as phosphoric acid and sulfuric acid at a temperature of 100 to 200° C. thereby obtaining a naphthenic compound of formula (1) wherein A is a naphthenic ester group represented by formula (16):

(c)

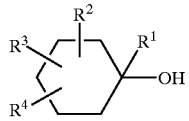

(d)

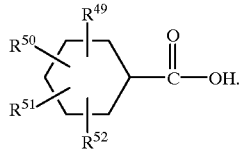

Ester Interchange Reaction

A cyclohexanol compound represented by the above formula (c) and a cyclohexanecarboxylate compound represented by formula (e) below is subjected to an ester interchange reaction using an alkaline catalyst such as metallic sodium, sodium hydroxide, and potassium hydroxide at a temperature of 100 to 200° C. thereby obtaining a naphthenic compound of formula (1) wherein A is a naphthenic ester group of formula (16):

(e)

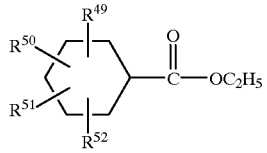

(iv) Naphthenic carbonate groups represented by formula (19)

(19)

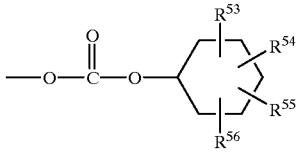

In formula (19), $R^{53}$ through $R^{56}$ are each independently hydrogen or an alkyl group, which may have a naphthene ring, having 1 to 8 carbon atoms, preferably hydrogen or an alkyl group having 1 to 4 carbon atoms, and more preferably hydrogen or methyl.

No particular limitation is imposed on a method of synthesizing a naphthenic compound of formula (1) wherein A is a naphthenic carbonate group (iv), various conventionally known methods may be employed. For instance, a naphthenic compound of formula (1) wherein A is a naphthenic carbonate group of formula (19) is may be synthesized by the following ester interchange reaction.

Ester Interchange Reaction

Diethyl carbonate represented by formula (f) below and cyclohexanol compounds represented by formulae (c) above and formula (g) below are subjected to an ester interchange reaction using an alkaline catalyst such as metallic sodium, sodium hydroxide, and potassium hydroxide at a temperature of 100 to 200° C. thereby obtaining a naphthenic compound of formula (1) wherein A is a naphthenic ester group of formula (19):

(f)

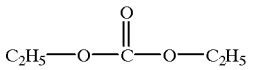

(g)

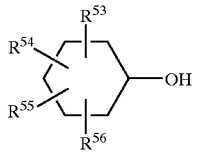

Specific examples of the alkyl group having 1 to 8 carbon atoms for $R^9$ through $R^{56}$ in formula (8) through (19) are methyl, ethyl, propyl, butyl, pentyl, hexyl, heptyl, and octyl groups which may be straight or branched.

As described above, a traction drive fluid represented by formula (1) encompasses compounds having the various structures. Among these compounds, a traction drive fluid according to the present invention is preferably a naphthenic compound represented by formula (2) because of its excellent traction coefficient (2)

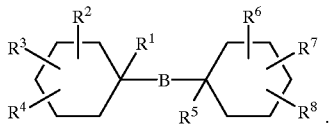

In formula (2), $R^1$ is an alkyl group, which may have a naphthene ring, having 1 to 8 carbon atoms, preferably 1 to 4 carbon atoms, and more preferably methyl. $R^2$ through $R^8$ are each independently hydrogen or an alkyl group, which may have naphthene ring, having 1 to 8 carbon atoms, preferably hydrogen or an alkyl group having 1 to 4 carbon atoms, and more preferably hydrogen or methyl. Amongst, both of $R^1$ and $R^5$ are preferably alkyl groups, which may have a naphthene ring, having 1 to 8 carbon atoms, more preferably alkyl groups having 1 to 4 carbon atoms, and the most preferably methyl groups. B in formula (2) is an alkylene group or indicates the form of bond between the two naphthene rings selected from the group consisting of a direct bond, an ester bond, and a carbonate bond.

Specific examples of the alkyl group, which may have a naphthene ring, having 1 to 8 carbon atoms are alkyl groups such as methyl, ethyl, propyl, butyl, pentyl, hexyl, heptyl, and octyl groups; (alkyl)cyclopentylalkyl groups whose alkyl group may be straight or branched and located at any position of the cyclopentyl group, such as cyclopentylmethyl, cyclopentylethyl, cyclopentylpropyl, methylcyclopentylmethyl, ethylcyclopentylmethyl, dimethylcyclopentylmethyl, and methylcyclopentylethyl groups; (alkyl)cyclohexylalkyl groups whose alkyl group may be straight or branched and located at any position of the cyclohexyl group, such as cyclohexylmethyl, cyclohexylethyl, and methylcyclohexylmethyl groups; and (alkyl)cycloheptylalkyl groups whose alkyl group may be straight or branched and located at any position of the cycloheptyl group, such as cycloheptylmethyl.

Specific examples of B in formula (2) are as follows.

(i) Direct bond: a state in which the carbon atom bonding to $R^1$ bonds to the carbon atoms bonding to $R^5$, (ii) Alkylene group: groups represented by the formulae (20)

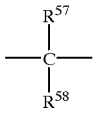

(21)

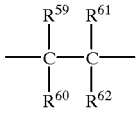

(22)

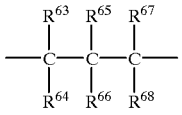

In formulae (20) through (22), $R^{57}$ through $R^{68}$ are each independently hydrogen or an alkyl group, which may have a naphthene ring, having 1 to 8 carbon atoms, preferably hydrogen or an alkyl group having 1 to 4 carbon atoms, and more preferably hydrogen or methyl. Specific examples of the alkyl group having 1 to 8 carbon atoms are methyl, ethyl, propyl, butyl, pentyl, hexyl, heptyl, and octyl groups, all of which may be straight or branched.

(iii) Ester bond: bonding forms represented by the formula (23)

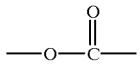

(24)

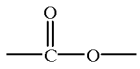

(25)

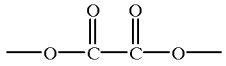

(iv) Carbonate bond: bonding form represented by the formula (26)

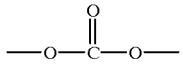

As described above, a traction drive fluid represented by formula (2) encompasses compounds having the various structures. Among these compounds, a traction drive fluid according to the present invention is more preferably a naphthenic compound represented by formula (3) because of its excellent traction coefficient (3)

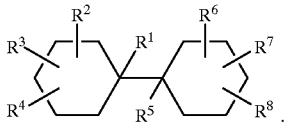

In formula (3), $R^1$ is an alkyl group, which may have a naphthene ring, having 1 to 8 carbon atoms, preferably an alkyl group having 1 to 4 carbon atoms, and more preferably methyl. $R^2$ through $R^8$ are each independently hydrogen or an alkyl group, which may have a naphthene ring, having 1 to 8 carbon atoms, preferably hydrogen or an alkyl group having 1 to 4 carbon atoms, and more preferably hydrogen or methyl. Particularly, both $R^1$ and $R^5$ are preferably alkyl groups, which may have a naphthene ring, having 1 to 8 carbon atoms, more preferably alkyl groups having 1 to 4 carbon atoms, and most preferably methyl groups.

Specific examples of the alkyl group, which may have a naphthene ring, having 1 to 8 carbon atoms are alkyl groups such as methyl, ethyl, propyl, butyl, pentyl, hexyl, heptyl, and octyl groups; (alkyl)cyclopentylalkyl groups whose alkyl group may be straight or branched and located at any position of the cyclopentyl group, such as cyclopentylmethyl, cyclopentylethyl, cyclopentylpropyl, methylcyclopentylmethyl, ethylcyclopentylmethyl, dimethylcyclopentylmethyl, and methylcyclopentylethyl groups; (alkyl) cyclohexylalkyl groups whose alkyl group may be straight or branched and located at any position of the cyclohexyl group, such as cyclohexylmethyl, cyclohexylethyl, and methylcyclohexylmethyl groups; an d (alkyl) cycloheptylalkyl groups whose alkyl group may be straight or branched and located at any position of the cycloheptyl group, such as cycloheptylmethyl.

Furthermore, among the naphthenic compounds represented by formula (3), preferred are those represented by formula (4) because of their high traction coefficient (4)

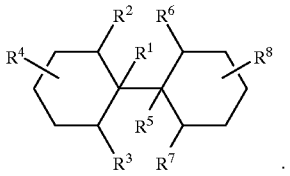

In formula (4), $R^1$ is an alkyl group, which may have a naphthene ring, having 1 to 8 carbon atoms, preferably an alkyl group having 1 to 4 carbon atoms, and more preferably methyl. $R^2$ through $R^8$ are each independently hydrogen or an alkyl group, which may have a naphthene ring, having 1 to 8 carbon atoms, preferably hydrogen or an alkyl group having 1 to 4 carbon atoms, and more preferably hydrogen or methyl. Preferably, at least one of $R^2$, $R^3$, $R^6$ and $R^7$ is an alkyl group, which may have a naphthene ring, having 1 to 8 carbon atoms, an alkyl group having 1 to 4 carbon atoms, and more preferably methyl. More preferably, both $R^1$ and $R^5$ are alkyl groups, which may have a naphthene ring, having 1 to 8 carbon atoms, alkyl groups having 1 to 4 carbon atoms, and more preferably methyl groups.

Specific examples of the alkyl group, which may have a naphthene ring, having 1 to 8 carbon atoms are alkyl groups such as methyl, ethyl, propyl, butyl, pentyl, hexyl, heptyl, and octyl groups; (alkyl)cyclopentylalkyl groups whose alkyl group may be straight or branched and located at any position of the cyclopentyl group, such as cyclopentylmethyl, cyclopentylethyl, cyclopentylpropyl, methylcyclopentylmethyl, ethylcyclopentylmethyl, dimethylcyclopentylmethyl, and methylcyclopentylethyl groups; (alkyl) cyclohexylalkyl groups whose alkyl group may be straight or branched and located at any position of the cyclohexyl group, such as cyclohexylmethyl, cyclohexylethyl, and methylcyclohexylmethyl groups; and (alkyl)cycloheptylalkyl groups whose alkyl group may be straight or branched and located at any position of the cycloheptyl group, such as cycloheptylmethyl.

Among the naphthenic compounds represented by formula (3), preferred are those represented by formula (5) because of their viscosity at low temperatures (5)

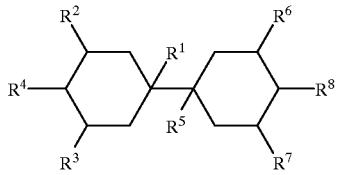

In formula (5), $R^1$ is an alkyl group, which may have a naphthene ring, having 1 to 8 carbon atoms, preferably an alkyl group having 1 to 4 carbon atoms, and more preferably methyl. $R^2$ through $R^8$ are each independently hydrogen or an alkyl group, which may have a naphthene ring, having 1 to 8 carbon atoms, preferably hydrogen or an alkyl group having 1 to 4 carbon atoms, and more preferably hydrogen or methyl. Preferably, at least one of $R^2$, $R^3$, $R^6$ and $R^7$ is an alkyl group, which may have a naphthene ring, having 1 to 8 carbon atoms, an alkyl group having 1 to 4 carbon atoms, and more preferably methyl. More preferably, both $R^1$ and $R^5$ are alkyl groups, which may have a naphthene ring, having 1 to 8 carbon atoms, alkyl groups having 1 to 4 carbon atoms, and more preferably methyl groups.

Specific examples of the alkyl group, which may have a naphthene ring, having 1 to 8 carbon atoms are alkyl groups such as methyl, ethyl, propyl, butyl, pentyl, hexyl, heptyl, and octyl groups; (alkyl)cyclopentylalkyl groups whose alkyl group may be straight or branched and located at any position of the cyclopentyl group, such as cyclopentylmethyl, cyclopentylethyl, cyclopentylpropyl, methylcyclopentylmethyl, ethylcyclopentylmethyl, dimethylcyclopentylmethyl, and methylcyclopentylethyl groups; (alkyl)cyclohexylalkyl groups whose alkyl group may be straight or branched and located at any position of the cyclohexyl group, such as cyclohexylmethyl, cyclohexylethyl, and methylcyclohexylmethyl groups; and (alkyl)cycloheptylalkyl groups whose alkyl group may be straight or branched and located at any position of the cycloheptyl group, such as cycloheptylmethyl.

Among the naphthenic compounds represented by formula (1), preferred are those represented by formula (6) because of their excellent traction coefficient (6)

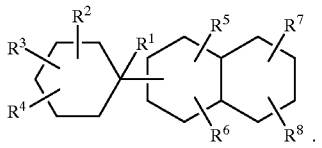

In formula (6), $R^1$ is an alkylene group, which may have a naphthene ring, having 1 to 8 carbon atoms, preferably an alkyl group having 1 to 4 carbon atoms, and more preferably methyl. $R^2$ through $R^8$ are each independently hydrogen or an alkyl group, which may have a naphthene ring, having 1 to 8 carbon atoms, preferably hydrogen or an alkyl group having 1 to 4 carbon atoms, and more preferably hydrogen or methyl.

Specific examples of the alkyl group, which may have a naphthene ring, having 1 to 8 carbon atoms are alkyl groups such as methyl, ethyl, propyl, butyl, pentyl, hexyl, heptyl, and octyl groups; (alkyl)cyclopentylalkyl groups whose alkyl group may be straight or branched and located at any position of the cyclopentyl group, such as cyclopentylmethyl, cyclopentylethyl, cyclopentylpropyl, methylcyclopentylmethyl, ethylcyclopentylmethyl, dimethylcyclopentylmethyl, and methylcyclopentylethyl groups; (alkyl) cyclohexylalkyl groups whose alkyl group may be straight or branched and located at any position of the cyclohexyl group, such as cyclohexylmethyl, cyclohexylethyl, and methylcyclohexylmethyl groups; an d (alkyl) cycloheptylalkyl groups whose alkyl group may be straight or branched and located at any position of the cycloheptyl group, such as cycloheptylmethyl.

More specifically, the compounds of formula (6) are exemplified by those having structures represented by formulae (27) and (28)

(27)

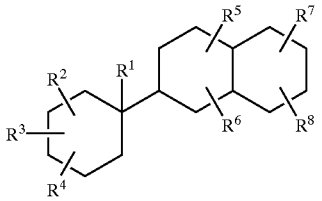

(28)

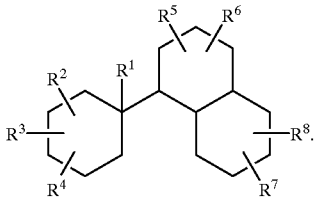

In formulae (27) and (28), $R^1$ through $R^8$ are the same as those in formula (6). Therefore, $R^1$ is an alkyl group, which may have a naphthene ring, having 1 to 8 carbon atoms, an alkyl group having 1 to 4 carbon atoms, and more preferably methyl. $R^2$ through $R^8$ are each independently hydrogen or an alkyl group, which may have a naphthene ring, having 1 to 8 carbon atoms, preferably hydrogen or an alkyl group having 1 to 4 carbon atoms, and more preferably hydrogen or methyl.

Among these compounds of formulae (27) and (28), preferred are those represented by formulae (29) and (30) because of their excellent traction coefficient (29)

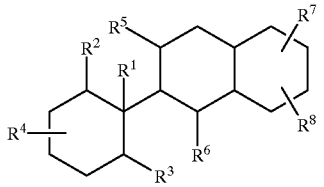

(30)

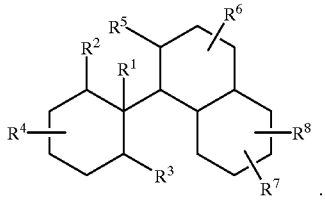

In formulae (29) and (30), $R^1$ through $R^8$ are each the same as those in formula (6). Therefore, $R^1$ is an alkyl group, which may have a naphthene ring, having 1 to 8 carbon atoms, an alkyl group having 1 to 4 carbon atoms, and more preferably methyl. $R^2$ through $R^8$ are each independently hydrogen or an alkyl group, which may have a naphthene ring, having 1 to 8 carbon atoms, preferably hydrogen or an alkyl group having 1 to 4 carbon atoms, and more preferably hydrogen or methyl.

Particularly preferred are compounds of formula (29) wherein $R^1$ is an alkyl group having 1 to 4 carbon atoms, preferably methyl; and $R^4$, $R^7$, and $R^8$ are each hydrogen and all of $R^2$, $R^3$, $R^5$, and $R^6$ are hydrogen, or alternatively at least one of $R^2$, $R^3$, $R^5$, and $R^6$ is an alkyl group having 1 to 4 carbon atoms, preferably methyl, and the others are each hydrogen. Particularly preferred are compounds of formula (30) wherein $R^1$ is an alkyl group having 1 to 4 carbon atoms, preferably methyl; and $R^4$, $R^6$, $R^7$, and $R^8$ are each hydrogen and all of $R^2$, $R^3$, and $R^5$ are hydrogen or at least one of $R^2$, $R^3$, and $R^5$ is an alkyl group having 1 to 4 carbon atoms, preferably methyl and the others are hydrogen.

Among the compounds represented by formula (1), preferred in terms of excellent traction coefficient are those represented by formula (7)

(7)

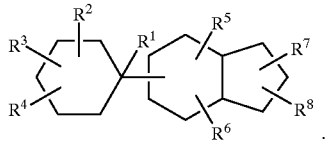

In formula (7), $R^1$ is an alkyl group, which may have a naphthene ring, having 1 to 8 carbon atoms, preferably an alkyl group having 1 to 4 carbon atoms, and more preferably methyl. $R^2$ through $R^8$ are each independently hydrogen or an alkyl group, which may have a naphthene ring, having 1 to 8 carbon atoms, preferably hydrogen or an alkyl group having 1 to 4 carbon atoms, and more preferably hydrogen or methyl.

Specific examples of the alkyl group, which may have a naphthene ring, having 1 to 8 carbon atoms are alkyl groups such as methyl, ethyl, propyl, butyl, pentyl, hexyl, heptyl, and octyl groups; (alkyl)cyclopentylalkyl groups whose alkyl group may be straight or branched and located at any position of the cyclopentyl group, such as cyclopentylmethyl, cyclopentylethyl, cyclopentylpropyl, methylcyclopentylmethyl, ethylcyclopentylmethyl, dimethylcyclopentylmethyl, and methylcyclopentylethyl groups; (alkyl)cyclohexylalkyl groups whose alkyl group may be straight or branched and located at any position of the cyclohexyl group, such as cyclohexylmethyl, cyclohexylethyl, and methylcyclohexylmethyl groups; an d (alkyl) cycloheptylalkyl groups whose alkyl group may be straight or branched and located at any position of the cycloheptyl group, such as cycloheptylmethyl.

More specifically, the compounds of formula (7) are exemplified by compounds having structures represented by formulae (31) and (32)

(31)

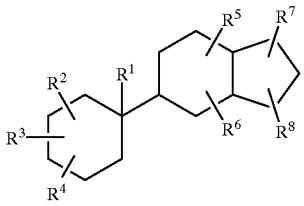

(32)

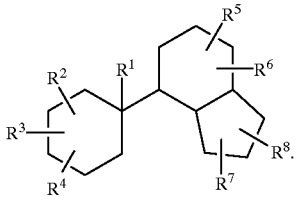

In formulae (31) and (32), $R^1$ through $R^8$ are the same as those in formula (7). Therefore, $R^1$ is an alkyl group, which may have a naphthene ring, having 1 to 8 carbon atoms, preferably 1 to 4 carbon atoms, and more preferably methyl. $R^2$ through $R^8$ are each independently hydrogen or an alkyl group, which may have a naphthene ring, having 1 to 8 carbon atoms, preferably hydrogen or an alkyl group having 1 to 4 carbon atoms, and more preferably hydrogen or methyl.

Among these compounds, preferred are those represented by formulae (33) and (34) because of their excellent traction drive coefficient (33)

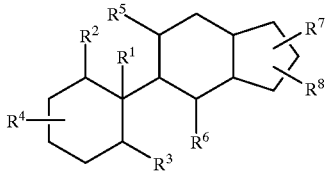

(34)

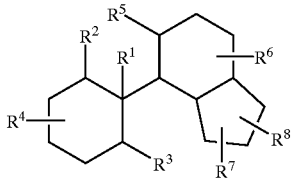

In formulae (33) and (34), $R^1$ through $R^8$ are the same as those in formula (7). Therefore, $R^1$ is an alkyl group, which may have a naphthene ring, having 1 to 8 carbon atoms, preferably 1 to 4 carbon atoms, and more preferably methyl. $R^2$ through $R^8$ are each independently hydrogen or an alkyl group, which may have a naphthene ring, having 1 to 8 carbon atoms, preferably hydrogen or an alkyl group having 1 to 4 carbon atoms, and more preferably hydrogen or methyl.

Particularly preferred are those of formula (33) wherein $R^1$ is an alkyl group having 1 to 4 carbon atoms, preferably methyl, and $R^4$, $R^7$, and $R^8$ are each hydrogen while $R^2$, $R^3$, $R^5$, and $R^6$ are each hydrogen or at least one of them is an alkyl group having 1 to 4 carbon atoms or methyl and the others are hydrogen. Particularly preferred are those of formula (34) wherein $R^1$ is an alkyl group having 1 to 4 carbon atoms, preferably methyl, and $R^4$, $R^6$, $R^7$, and $R^8$ are each hydrogen while $R^2$, $R^3$, and $R^5$ are each hydrogen or at least one of them is an alkyl group having 1 to 4 carbon atoms, preferably methyl and the others are hydrogen.

In the present invention, one or more naphthenic compounds of formulae (1) through (7) may be put in use as they are. However, in order to enhance flowability at low temperatures and viscosity-temperature characteristics, they may be blended with at least one member selected from (A) a mineral oil and a synthetic oil having a molecule weight of 150 to 800, preferably 150 to 500.

Specific examples of mineral oils which may be used include paraffinic- and naphthenic-mineral oils which are produced by subjecting lubricant fractions resulting from the vacuum distillation of residues derived from the atmospheric distillation of crude oil to refining processes such as solvent deasphalting, solvent extraction, hydrocracking, solvent dewaxing, catalytic dewaxing, hydrorefining, sulfuric acid washing, and clay treatment in suitable combination; and n-paraffinic mineral oils. The kinematic viscosity of these mineral oils are not limited but is usually within the range of 1 to 10 $mm^2/s$, preferably 2 to 8 $mm^2/s$.

In the present invention, a synthetic oil has necessarily a molecular weight of 150 to 800, preferably 150 to 500. Molecular weight less than 150 would lead to an increase in evaporation loss, while that greater than 800 would result in a deterioration in flowability at low temperature.

Eligible synthetic oils include poly-α-olefins such as 1-octene oligomer, 1-decene olygomer, and ethylene-propylene oligomer, and hydrides thereof, isoparaffin, alkylbenzene, alkylnaphthalene, diesters such as ditridecyl glutarate, di-2-ethylhexyl adipate, diisodecyl adipate, ditridecyl adipate, and di-2-ethylhexyl sebacate), polyol esters such as trimethylolpropane caprylate, trimethylolpropane pelargonate, pentaerythritol-2-ethyl hexanoate, and pentaerythritol pelargonate, polyoxyalkylene glycol, dialkyldiphenyl ether, and polyphenylether.

Among these synthetic oils, isobutene oligomer, hydrides thereof and synthetic oils represented by formulae (35) through (44) are particularly preferred because the synthetic oils with the aforesaid naphthenic compound are contributive to the production of a traction drive fluid which is enhanced in traction coefficient and viscosity at elevated temperatures and excelled in flowability at low temperatures and thus have totally excellent performances:

(35)

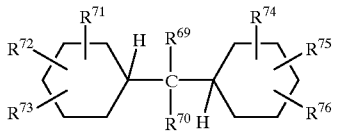

wherein $R^{69}$ through $R^{76}$ are each independently hydrogen or an alkyl group, which may have a naphthene ring, having 1 to 8 carbon atoms, preferably hydrogen or an alkyl group having 1 to 4 carbon atoms, and more preferably hydrogen or methyl;

(36)

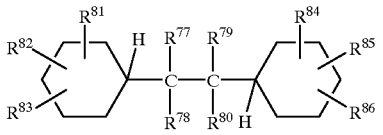

wherein $R^{77}$ through $R^{86}$ are each independently hydrogen or an alkyl group, which may have a naphthene ring, having 1 to 8 carbon atoms, preferably hydrogen or an alkyl group having 1 to 4 carbon atoms, and more preferably hydrogen or methyl;

(37)

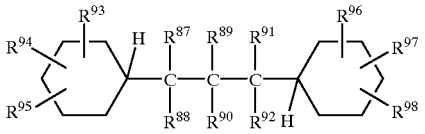

wherein $R^{87}$ through $R^{98}$ are each independently hydrogen or an alkyl group, which may have a naphthene ring, having 1 to 8 carbon atoms, preferably hydrogen or an alkyl group having 1 to 4 carbon atoms, and more preferably hydrogen or methyl;

(38)

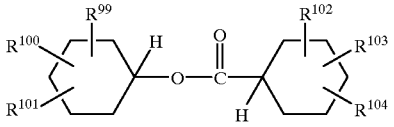

wherein $R^{99}$ through $R^{104}$ are each independently hydrogen or an alkyl group, which may have a naphthene ring, having 1 to 8 carbon atoms, preferably hydrogen or an alkyl group having 1 to 4 carbon atoms, and more preferably hydrogen or methyl;

(39)

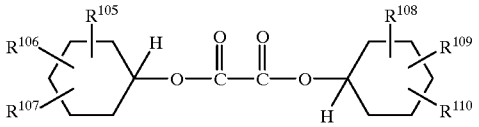

wherein $R^{105}$ through $R^{110}$ are each independently hydrogen or an alkyl group, which may have a naphthene ring, having 1 to 8 carbon atoms, preferably hydrogen or an alkyl group having 1 to 4 carbon atoms, and more preferably hydrogen or methyl;

(40)

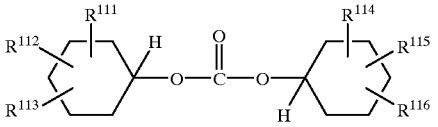

wherein $R^{111}$ through $R^{116}$ are each independently hydrogen or an alkyl group, which may have a naphthene ring, having 1 to 8 carbon atoms, preferably hydrogen or an alkyl group having 1 to 4 carbon atoms, and more preferably hydrogen or methyl;

(41)

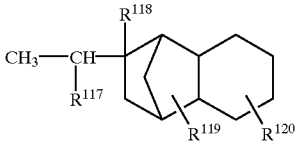

wherein both $R^{117}$ and $R^{118}$ are hydrogen or either one of $R^{117}$ and $R^{118}$ is hydrogen and the other is a methyl, and $R^{119}$ and $R^{120}$ are each independently hydrogen or an alkyl group, which may have a naphthene ring, having 1 to 8 carbon atoms, preferably hydrogen or an alkyl group having 1 to 4 carbon atoms, and more preferably hydrogen or methyl;

(42)

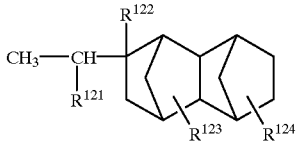

wherein both $R^{121}$ and $R^{122}$ are hydrogen or either one of $R^{121}$ and $R^{122}$ is hydrogen and the other is an alkyl group, which may have a naphthene ring, having 1 to 8 carbon atoms, preferably hydrogen or an alkyl group having 1 to 4 carbon atoms, and more preferably hydrogen or methyl;

(43)

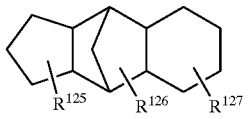

wherein $R^{125}$ through $R^{127}$ are each independently hydrogen or an alkyl group, which may have a naphthene ring, having 1 to 8 carbon atoms, preferably hydrogen or an alkyl group having 1 to 4 carbon atoms, and more preferably hydrogen or methyl; and (44)

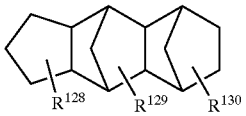

wherein $R^{128}$ through $R^{130}$ are each independently hydrogen or an alkyl group, which may have a naphthene ring, having 1 to 8 carbon atoms, preferably hydrogen or an alkyl group having 1 to 4 carbon atoms, and more preferably hydrogen or methyl.

Specific examples of the alkyl group, which may have a naphthene ring, having 1 to 8 carbon atoms for $R^{69}$ through $R^{116}$, $R^{110}$ through $R^{120}$, and $R^{122}$ through $R^{130}$ in formulae (35) through (44) are alkyl groups such as methyl, ethyl, propyl, butyl, pentyl, hexyl, heptyl, and octyl groups; (alkyl) cyclopentylalkyl groups whose alkyl group may be straight or branched and located at any position of the cyclopentyl group, such as cyclopentylmethyl, cyclopentylethyl, cyclopentylpropyl, methylcyclopentylmethyl, ethylcyclopentylmethyl, dimethylcyclopentylmethyl, and methylcyclopentylethyl groups; (alkyl)cyclohexylalkyl groups whose alkyl group may be straight or branched and located at any position of the cyclohexyl group, such as cyclohexylmethyl, cyclohexylethyl, and methylcyclohexylmethyl groups; and (alkyl)cycloheptylalkyl groups whose alkyl group may be straight or branched and located at any position of the cycloheptyl group, such as cycloheptylmethyl.

When Component (A) is contained in a traction fluid according to the present invention, no particular limitation is imposed on the amount of Component (A). However, the weight ratio of a naphthenic compound of formula (1) through (7) is within the range of 1:99 to 99:1, preferably 5:95 to 95:5 in an effort to impart the resulting composition with enhanced flowability and viscosity-temperature characteristics.

A traction drive fluid according to the present invention contains preferably a viscosity index improver hereinafter referred to as Component (B).

Viscosity index improvers (Component (B)) which may be used in the present invention are non-dispersion type and/or dispersion type viscosity index improvers.

Specific examples of the non-dispersion type-viscosity index improvers are (B-1) polymers or copolymers of one or more monomers selected from the group consisting of compounds represented by formulae (45), (46) and (47) below, and hydrides of the polymers or the copolymers:

(45)

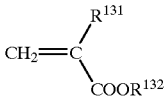

(46)

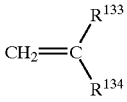

and

-continued (47)

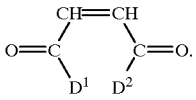

Specific examples of dispersion type-viscosity index improvers are copolymers of two or more monomers selected from the group consisting of compounds represented by formula (48) below; ones obtained by introducing an oxygen-containing group into hydrides of the copolymers; copolymers of one or more monomers selected from the group consisting of compounds represented by formulae (45), (46) and (47) above with one or more monomers (B-2) selected from the group consisting of compounds represented by formulae (48) and (49) below; and hydrides of the copolymers:

(48)

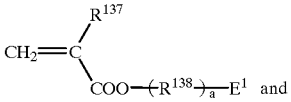

and (49)

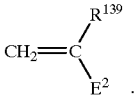

In formula (45), $R^{131}$ is hydrogen or methyl, and $R^{132}$ is an alkyl group having 1 to 18 carbon atoms.

Specific examples of alkyl groups for $R^{132}$ are straight or branched alkyl groups such as methyl, ethyl, propyl, butyl, pentyl, hexyl, heptyl, octyl, nonyl, decyl, undecyl, dodecyl, tridecyl, tetradecyl, pentadecyl, hexadecyl, heptadecyl, and octadecyl groups.

In formula (46), $R^{133}$ is hydrogen or methyl, and $R^{134}$ is hydrogen or a hydrocarbon group having 1 to 12 carbon atoms.

Specific examples of hydrocarbon groups for $R^{134}$ are straight or branched alkyl groups such as methyl, ethyl, propyl, butyl, pentyl, hexyl, heptyl, octyl, nonyl, decyl, undecyl, and dodecyl groups; straight or branched alkenyl groups, the position of which the double bond may vary, such as butenyl, pentenyl, hexenyl, heptenyl, octenyl, nonenyl, decenyl, undecenyl, and dodecenyl groups; cycloalkyl groups having 5 to 7 carbon atoms, such as cyclopentyl, cyclohexyl, and cycloheptyl groups; alkylcycloalkyl groups having 6 to 11 carbon atoms, the position of which the alkyl group may vary, such as methylcyclopentyl, dimethylcyclopentyl, methylethylcyclopentyl, diethylcyclopentyl, methylcyclohexyl, dimethylcyclohexyl, methylethylcyclohexyl, diethylcyclohexyl, methylcycloheptyl, dimethylcycloheptyl, methylethylcycloheptyl, and diethylcycloheptyl groups; aryl groups such as phenyl and naphtyl groups; straight or branched alkylaryl groups having 7 to 12 carbon groups, the position of which the alkyl group may vary, such as tolyl, xylyl, ethylphenyl, propylphenyl, butylphenyl, pentylphenyl, and hexylphenyl groups; and phenylalkyl groups having 7 to 12 carbon atoms, whose alkyl group may be straight or branched, such as benzyl, phenylethyl, phenylpropyl, phneylbutyl, phenylpentyl, and phenylhexyl groups.

In formula (47), $D^1$ and $D^2$ are each independently hydrogen or a residue of an alkylalcohol having 1 to 18 carbon atoms represented by the formula —$OR^{135}$ wherein $R^{135}$ is an alkyl group having 1 to 18 carbon atoms or a residue of a monoalkylamine having 1 to 18 carbon atoms represented by the formula —$NHR^{136}$ wherein $R^{136}$ is an alkyl group having 1 to 18 carbon atoms.

In formula (48), $R^{137}$ is hydrogen or methyl, $R^{138}$ is an alkylene group having 2 to 18 carbon atoms, $E^1$ is an amine residue or heterocyclic residue having 1 or 2 nitrogen and 0 to 2 oxygen, and a is an integer of 0 or 1.

Specific examples of alkylene groups for $R^{138}$ are straight or branched alkylene group such as ethylene, propylene, butylene, pentylene, hexylene, heptylene, octylene, nonylene, decylene, undecylene, dodecylene, tridecylene, tetradecylene, pentadecylene, hexadecylene, heptadecylene, and octadecylene groups.

Specific examples of $E^1$ are dimethylamino, diethylamino, dipropylamino, dibutylamino, anilino, toluidino, xylidino, acetylamino, benzoilamino, morpholino, pyrolyl, pyridyl, methylpydidyl, pyrolidinyl, piperidinyl, quinonyl, pyrrolidonyl, pyrrolidono, imidazolino, and pyrazino groups.

In formula (49), $R^{139}$ is hydrogen or methyl, and $E^2$ is an amino- or heterocyclic-residue having 1 or 2 nitrogen and 0 to 2 oxygen.

Specific examples of $E^2$ are dimethylamino, diethylamino, dipropylamino, dibutylamino, anilino, toluidino, xylidino, acetylamino, benzoilamino, morpholino, pyrolyl, pyridyl, methylpydidyl, pyrolidinyl, piperidinyl, quinonyl, pyrrolidonyl, pyrrolidono, imidazolino, and pyrazino groups.

Preferred monomers for Component (B-1) are an alkylacrylate having 1 to 18 carbon atoms, an alkylmethacrylate having 1 to 18 carbon atoms, an olefin having 2 to 20 carbon atoms, styrene, methylstyrene, maleic anhydride ester, maleic abhydride amide, and mixtures thereof.

Preferred monomers for Component (B-2) are dimethylaminomethylmethacrylate, diethylaminomethylmethacrylate, dimethylaminoethylmethacrylate, Diethylaminoethylmethacrylate, 2-methyl-5-vinylpyridine, morpholinomethylmethacrylate, morpholinoethylmethacrylate, N-vinylpyrrolidone, and mixtures thereof.

When one or more monomers selected from compounds (B-1) is copolymerized with one or more monomers selected from compounds (B-2), the molar ratio of (B-1) to (B-2) is arbitrary selected but is within the range of 80:20 to 95:5. Although no particular limitation is imposed on the copolymerization method, such copolymers are generally obtained by radical-solution polymerization of Component (B-1) with Component (B-2) in the presence of a polymerization initiator such as benzoyl peroxide.

Specific examples of the viscosity index improvers are non-dispersion type- and dispersion type-polymethacrylates, non-dispersion type- and dispersion type-ethylene-α-olefin copolymers and hydrides thereof, polyisobutylene and hydrides thereof, styrene-diene hydrogenated copolymers, styrene-maleic anhydrides copolymers, and polyalkylstyrene.

The addition of one or more compounds selected from Components (B), i.e., viscosity index improvers make it possible to enhance viscosity at elevated temperatures particularly required for an automobile traction drive fluid and improve the balance of the same with low-temperature flowability.

In general, the viscosity index improver is used together with a solvent for synthesis thereof. In the present invention, preferred solvents for synthesizing the viscosity index improver are naphthenic compounds represented by formulae (1) through (7), isobuten oligomer or hydrides thereof, and compounds represented by formulae (35) through (44).

The molecular weight of Component (B) is preferably selected in view of shear stability. Specifically, it is desired that the dispersion type and non-dispersion type-polymethacrylates have a molecular weight of 5,000 to 150,000, preferably 5,000 to 35,000. It is also desired that the polyisobutylnes and hydrides thereof have a molecular weight of 800 to 5,000, preferably 2,000 to 4,000. Polyisobutylenes and hydrides thereof having a number average molecular weight of less than 800 would reduce the thickening characteristics and traction coefficient of the resulting traction drive fluid, while those having a number average molecular weight in excess of 5,000 would deteriorate the shear stability and flowability at low temperatures of the resulting traction drive fluid.

Ethylene-α-olefin copolymers and hydrides thereof having a number average molecular weight of less than 800 would reduce the thickening characteristics and traction coefficient of the resulting traction drive fluid, while those having a number average molecular weight in excess of 150,000 would deteriorate the shear stability of the resulting traction drive fluid.

No particular limitation is imposed on the content of ethylene component. However, the content of ethylene component is within the range of preferably 30 to 80 percent by mole, and more preferably 50 to 80 percent by mole. Eligible α-olefins are propylene and 1-butene. The former is more preferred.

No particular limitation is imposed on the content of Component (B). In general, it is contained in an amount of preferably 0.1 to 20 percent by mass, more preferably 0.1 to 10 percent by mass, based on the total mass of a traction drive fluid. The content of Component (B) in excess of 20 percent by mass would reduce the traction coefficient of the resulting traction drive fluid, while that less than 0.1 percent by mass would result in poor effect.

A traction drive fluid according to the present invention contains preferably an ashless dispersant hereinafter referred to as Component (C) and a phosphorus-containing additive hereinafter referred to as Component (D).

The addition of Components (C) and (D) can provide the resulting traction drive fluid with wear resistance characteristics, oxidation stability, and detergency which are required for hydraulic pressure controlling mechanisms.

In the present invention, eligible ashless dispersants (Component (C)) are nitrogen-containing compounds having at least one alkyl or alkenyl group having 40 to 400 carbon atoms, derivatives thereof, and modified products of alkenyl succinimides having at least one alkyl or alkenyl group having 40 to 400 carbon atoms. One or more members arbitrary selected from these compounds are blended wit a traction drive fluid according to the present invention.

The alkyl and alkenyl groups may be straight or branched. Preferred are branched alkyl and alkenyl groups derived from oligomers of olefins such as propylene, 1-butne, and isobutylene or cooligomers of ethylene and propylene.

The alkyl and alkenyl groups have 40 to 400 carbon atoms, preferably 60 to 350 carbon atoms. The alkyl and alkenyl groups having fewer than 40 carbon atoms would result in a compound having poor solubility to a lubricant base oil, those having over 400 carbon atoms would deteriorate the flowability at low temperatures of the resulting traction drive fluid.

No particular limitation is imposed on the content of the nitrogen-containing compound which is an example of Component (C). However, the content is within the range of 0.01 to 10 percent by mass, preferably 0.1 to 10 percent by mass.

Specific examples of Component (C) are one or more compounds selected from the followings:

(C-1) succinimides having at least one alkyl or alkenyl group having 40 to 400 carbon atoms and derivatives thereof;

(C-2) benzylamines having at least one alkyl or alkenyl group having 40 to 400 carbon atoms and derivatives thereof; and (C-3) polyamines having at least one alkyl or alkenyl group having 40 to 400 carbon atoms and derivatives thereof.

Specific examples of (C-1) succinimides are compounds represented by the formulae (50)

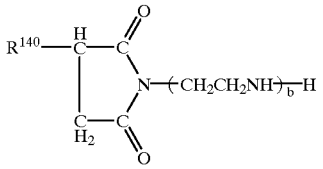

wherein $R^{140}$ is an alkyl or alkenyl group having 40 to 400, preferably 60 to 350 carbon atoms, and b is an integer of 1 to 5, preferably 2 to 4; and (51)

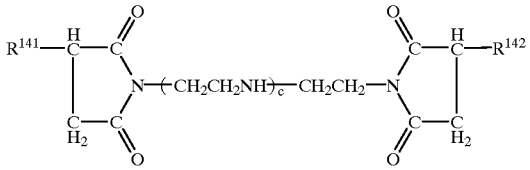

wherein $R^{141}$ and $R^{142}$ are each independently an alkyl or alkenyl group having 40 to 400, preferably 60 to 350 carbon atoms, and c is an integer of 0 to 4, preferably 1 to 3.

Succinimides can be classified as mono-type succinimides, as represented by formula (50), in which succinic anyhydride is added to one end of a polyamine and bis-type succinimides, as represented by formula (51), in which succinic anhydride is added to both ends of a polyamine. Both types of succinimides and mixtures thereof are eligible as Component (C).

Specific examples of (C-2) benzylamines are compounds represented by the formula (52)

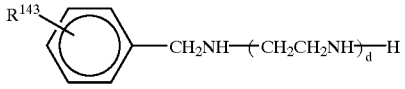

wherein $R^{143}$ is an alkyl or alkenyl group having 40 to 400, preferably 60 to 350 carbon atoms, and d is an integer of 2 to 4.

No particular limitation is imposed on a method for producing benzylamines. For example, benzylamines may be produced by reacting phenol with a polyolefin such as propylene oligomer, polybutene, and ethylene-α-copolymer to obtain an alkyphenol and then subjecting it to Mannich reaction with formaldehyde and a polyamine such as diethyltriamine, triethylenetetraamine, tetraethylenepentamine, and pentaethylenehexamine.

Specific examples of (C-3) polyamines are compounds represented by the formula (53)

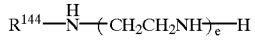

wherein $R^{144}$ is an alkyl or alkenyl group having 40 to 400, preferably 60 to 350 carbon atoms, and e is an integer of 1 to 5, preferably 2 to 4.

No particular limitation is imposed on a method for producing such polyamines. For Example, polyamines may be produced by chloridizing a polyolefin such as propylene oligomer, polybutene, and ethylene-α-copolymer and then reacting the resulting product with ammonia or a polyamine such as ethylenediamine, diethylenetriamine, triethylenetetramine, tetraethylenepentamine, and pentaethylenehexamine.

Derivatives of the nitrogen-containing compounds which is one example of Component (C) may be (i) an acid-modified compound obtained by allowing the above-described nitrogen-containing compound to react with monocarboxylic acid having 2 to 30 carbon atoms, such as fatty acid or polycarboxylic acid having 2 to 30 carbon atoms, such as oxalic acid, phthalic acid, trimellitic acid, and pyromellitic acid to neutralize the whole or part of the remaining amino and/or imino groups; (ii) a boron-modified compound obtained by allowing the above-described nitrogen-containing compound to react with boric acid to neutralize the whole or part of the remaining amino and/or imino groups; (iii) a sulfur-modified compound obtained by allowing the above-described nitrogen-containing compound to react with a sulfuric compound; and (iv) a modified compound obtained by two or more combination of acid-, boric acid-, and sulfur-modifications of the above-described nitrogen-containing compound.

No particular limitation is imposed on the content of Component (C) in a traction drive fluid according to the present invention. However, in general, Component (C) is contained in an amount of preferably 0.01 to 10.0 percent by mass, and more preferably 0.1 to 7.0 percent by mass, based on the total mass of a traction drive fluid. The content of Component (C) less than 0.01 percent by mass would be less effective in detergency, while the content in excess of 10.0 percent by mass would extremely deteriorate flowability at low temperatures.

Phosphorus-containing additives (Component (D)) which may be used in the present invention are alkyldithio zinc phosphate, phosphoric acid, phosphorous acid, monophosphates, diphosphates, triphosphates, monophosphites, diphosphites, triphosphites, salts of phosphates and phosphites, and mixtures thereof.

These exemplified compounds, besides phosphoric acid and phosphorus acid, are compounds having a hydrocarbon group having 2 to 30, preferably 3 to 20 carbon atoms.

Specific examples of the hydrocarbon group having 2 to 30 are a straight or branched alkyl group, such as ethyl, propyl, butyl, pentyl, hexyl, heptyl, octyl, nonyl, decyl, undecyl, dodecyl, tridecyl, tetradecyl, pentadecyl, hexadecyl, heptadecyl and octadecyl groups; a straight or branched alkenyl group, the position of which the double bond may vary, such as butenyl, pentenyl, hexenyl, heptenyl, octenyl, nonenyl, decenyl, undecenyl, dodecenyl, tridecenyl, tetradecenyl, pentadecenyl, hexadecenyl, heptadecenyl and octadecenyl groups; a cycloalkyl group having 5 to 7 carbon atoms, such as cyclopentyl, cyclohexyl, cycloheptyl groups; an alkylcycloalkyl group having 6 to 11 carbon atoms, of which the cycloalkyl group may possess an alkyl substituent at any position, such as methylcyclopentyl, dimethylcyclopentyl, methylethylcyclopentyl, diethylcyclopentyl, methylcyclohexyl, dimethylcyclohexyl, methylethylcyclohexyl, diethylcyclohexyl, methylcycloheptyl, dimethylcycloheptyl, methylethylcycloheptyl and diethylcycloheptyl groups; an aryl group such as phenyl and naphtyl groups; an alkylaryl group having 7 to 18 carbon atoms, of which the alkyl group may be straight or branched and of which the aryl group may possess an alkyl substituent at any position, such as tolyl, xylyl, ethylphenyl, propylphenyl, butylphenyl, pentylphenyl, hexylphenyl, heptyl phenyl, octylphenyl, nonylphenyl, decylphenyl, undecylphenyl and dodecylphenyl groups; an arylalkyl group having 7 to 12 carbon atoms, of which the alkyl group may be straight or branched, such as benzyl, phenylethyl, phenylpropyl, phenylbutyl, phenylpentyl and phenylhexyl groups.

Preferred compounds for Component (D) are phosphoric acid; phosphorus acid; alkyl zinc dithiophosphate, of which the alkyl group may be straight or branched, such as dipropyl zinc dithiophosphate, dibutyl zinc dithiophosphate, dipentyl zinc dithiophospahte, dihexyl zinc dithiophospahte, diheptyl zinc dithiophospahte and dioctyl zinc dithiophosphahte; monoalkyl phosphate, of which the alkyl group may be straight or branched, such as monopropyl phosphate, monobutyl phosphate, monopentyl phosphate, monohexyl phosphate, monoheptyl phospahte and monooctyl phosphate; mono(alkyl)aryl phosphate such as monophenyl phospahte and monocresyl phosphate; dialkyl phosphate, of which the alkyl group may be straight or branched, such as dipropyl phosphate, dibutyl phosphate, dipentyl phospahte, dihexyl phosphate, diheptyl phosphate and dioctyl phospahte; di(alkyl)aryl phosphate such as diphenyl phosphate and dicresyl phospahte; trialkyl phosphate, of which the alkyl group may be straight or branched, such as tripropyl phosphate, tributyl phosphate, tripentyl phosphate, trihexyl phosphate, triheptyl phosphate and trioctyl phosphate; tri(alkyl)aryl phosphate such as triphenyl phosphate and tricresyl phosphate; monoalkyl phosphite, of which the alkyl group may be straight or branched, such as monopropyl phosphite, monobutyl phosphite, monopentyl phosphite, monohexyl phosphite, monoheptyl phosphite and monooctyl phosphite; mono(alkyl)aryl phosphite such as monophenyl phosphite and monocresyl phosphite; dialkyl phosphite, of which the alkyl group may be straight or branched, such as dipropyl phosphite, dibutyl phosphite, dipentyl phosphite, dihexyl phosphite, diheptyl phosphite and dioctyl phosphite; di(alkyl)aryl phosphite such as diphenyl phosphite and dicresyl phosphite; trialkyl phosphite, of which the alkyl group may be straight or branched, such as tripropyl phosphite, tributyl phosphite, tripentyl phosphite, trihexyl phosphite, triheptyl phosphite and trioctyl phosphite; tri(alkyl)aryl phosphite, of which the alkyl group may be straight or branched, such as triphenyl phosphite and tricresyl phosphite; and mixtures thereof.

Specific examples of the salts of phosphites are those obtained by allowing monophosphate, diphosphate, monophosphite, or diphosphite to react with a nitrogen-containing compound such as ammonia or an amine compound having in its molecules only hydrocarbon or hydroxyl-containing groups having 1 to 8 carbon atoms so as to neutralize the whole or part of the remaining acid hydrogen.

Specific examples of the nitrogen-containing compound are ammonia; alkylamine, of which the alkyl group may be straight or branched, such as monomethylamine, monoethylamine, monopropylamine, monobutylamine, monopentylamine, monohexylamine, monoheptylamine, monooctylamine, dimethylamine, methylethylamine, diethylamine, methyipropylamine, ethylpropylamine, dipropylamine, methylbutylamine, ethylbutylamine, propylbutylamine, dibutylamine, dipentylamine, dihexylamine, diheptylamine and dioctylamine; an alkanolamine, of which the alkanol group may be straight or branched, such as monomethanolamine, monoethanolamine, monopropanolamine, monobutanolamine, monopentanolamine, monohexanolamine, monoheptanolamine, monooctanolamine, mononononanolamine, dimethanolamine, methanolethanolamine, diethanolamine, methanolpropanolamine, ethanolpropanolamine, dipropanolamine, methanolbutanolamine, ethanolbutanolamine, propanolbutanolamine, dibutanolamine, dipentanolamine, dihexanolamine, diheptanolamine and dioctanolamine; and mixtures thereof.

Components (D) may be blended alone or in combination with a traction drive fluid of the present invention.

Phosphorus compounds referred hereinbelow to as Component (E-2) having its molecules at least one alkyl or alkenyl group having 6–30 carbon atoms but no hydrocarbon groups of more than 31 carbon atoms and derivatives thereof may be used as Component (D) whereby a traction drive fluid according to the present invention can be imparted not only with the aforesaid anti-wear characteristics but also with optimized friction characteristics for a wet clutch.

No particular limitation is imposed on the content of Component (D) in a traction drive fluid according to the present invention. However, in general, the content of Component (D) is within the range of preferably 0.005 to 0.2 percent by mass on an phosphorus element basis, based on the total mass of a traction drive fluid. The content of Component (D) less than 0.005 percent by mass would be less effective in anti-abrasion characteristics, while that in excess of 0.2 percent by mass would deteriorate the oxidation stability of the resulting traction drive fluid.

A traction drive fluid according to the present invention contains preferably a friction modifier hereinafter referred to as Component (E).

Component (E) may be various compounds having in their molecules at least one alkyl or alkenyl group having 6 to 30 carbon atoms but no hydrocarbon groups having 31 or more carbon atoms. The addition of Component (E) is contributive to the production of a traction drive fluid having optimized friction characteristics.

The alkyl or alkenyl groups of Component (E) may be straight or branched but preferred compounds for Component (E) are those having these groups of 6 to 30, preferably 9 to 24 carbon atoms. Departures from the range of the specified carbon number would cause the deterioration of the friction characteristics of a wet-type clutch.

Specific examples of the alkyl and alkenyl groups are a straight or branched alkyl group such as hexyl, heptyl, octyl, nonyl, decyl, undecyl, dodecyl, tridecyl, tetradecyl, pentadecyl, hexadecyl, heptadecyl, octadecyl, nonadecyl, eicosyl, heneicosyl, docosyl, tricosyl, tetracosyl, pentacosyl, hexacosyl, heptacosyl, octacosyl, nonacosyl and triacontyl groups; and a straight or branched alkenyl group, the position of which double bond may vary, such as hexenyl, heptenyl, octenyl, nonenyl, decenyl, undecenyl, dodecenyl, tridecenyl, tetradecenyl, pentadecenyl, hexadecenyl, heptadecenyl, octadecenyl, nonadecenyl, eicosenyl, heneicosenyl, docosenyl, tricosenyl, tetracosenyl, pentacosenyl, hexacosenyl, heptacosenyl, octacosenyl, nonacosenyl and triacontenyl groups.

Friction modifiers containing a hydrocarbon group of 31 or more carbon atoms are not preferred because they would cause the deterioration of the friction characteristics of a wet-type clutch.

Specific examples of Component (E) are one or more compounds selected from the followings:

(E-1) an amine compound having in its molecules at least one alkyl or alkenyl group having 6 to 30 carbon atoms and no hydrocarbon group having 31 or more carbon atoms, and derivatives thereof;

(E-2) a phosphorus compound having in its molecules at least one alkyl or alkenyl group having 6 to 30 carbon atoms and no hydrocarbon group having 31 or more carbon atoms, and derivatives thereof; and (E-3) an amide or metallic salt of a fatty acid having in its molecules at least one alkyl or alkenyl group having 6 to 30 carbon atoms and no hydrocarbon group having 31 or more carbon atoms.

Specific examples of (E-1) a amine compound are aliphatic monoamines represented by the formula (54)

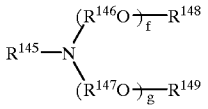

or alkyleneoxide adducts thereof;

aliphatic polyamines represented by the formula (55)

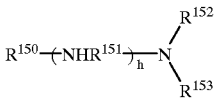

and imidazoline compounds represented by the formula (56)

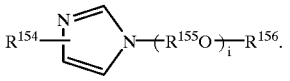

In formula (54), $R^{145}$ is analkyloralkenyl group having 6 to 30, preferably 9 to 24 carbon atoms, $R^{146}$ and $R^{147}$ are each independently ethylene or propylene, $R^{148}$ and $R^{149}$ are each independently hydrogen or a hydrocarbon group having 1 to 30 carbon atoms, f and g are each independently an integer of 0 to 10, preferably 0 to 6, and f+g=0 to 10, preferably 0 to 6.

In formula (55), $R^{150}$ is an alkyl or alkenyl group having 6 to 30, preferably 9 to 24 carbon atoms, $R^{151}$ is ethylene or propylene, $R^{152}$ and $R^{153}$ are each independently hydrogen or a hydrocarbon group having 1 to 30 carbon atoms, h is an integer of 1 to 5, preferably 1 to 4.

In formula (56), $R^{154}$ is an alkyl or alkenyl group having 6 to 30, preferably 9 to 24 carbon atoms, $R^{155}$ is ethylene or propylene, $R^{156}$ is hydrogen or a hydrocarbon group having 1 to 30 carbon atoms, and i is an integer of 0 to 10, preferably 0 to 6.

The alkyl and alkenyl groups for $R^{145}$, $R^{150}$ and $R^{154}$ may be straight or branched ones but have 6 to 30, preferably 9 to 24 carbon atoms. Alkyl or alkenyl groups having fewer than 6 carbon atoms or having 31 or greater carbon atoms are not preferred because they cause the deterioration of the friction characteristics of a wet clutch.

Specific examples of the alkyl or alkenyl groups for $R^{145}$, $R^{150}$, and $R^{154}$ are various alkyl and alkenyl groups as described above. Particularly preferred are straight alkyl or alkenyl groups having 12 to 18 carbon atoms, such as laulyl, myristyl, palmityl, stearyl, and oleyl groups because an excellent friction characteristics of a wet-type clutch can be achieved.

Specific examples of the groups for $R^{148}$, $R^{149}$, $R^{152}$, $R^{153}$, and $R^{156}$ are hydrogen and a straight or branched alkyl group, such as methyl, ethyl, propyl, butyl, pentyl, hexyl, heptyl, octyl, nonyl, decyl, undecyl, dodecyl, tridecyl, tetradecyl, pentadecyl, hexadecyl, heptadecyl, octadecyl, nonadecyl, eicosyl, heneicosyl, docosyl, tricosyl, tetracosyl, pentacosyl, hexacosyl, heptacosyl, octacosyl, nonacosyl and triacontyl groups; a straight or branched alkenyl group, the position of which the double bond may vary, such as butenyl, pentenyl, hexenyl, heptenyl, octenyl, nonenyl, decenyl, undecenyl, dodecenyl, tridecenyl, tetradecenyl, pentadecenyl, hexadecenyl, heptadecenyl, octadecenyl, nonadecenyl, eicosenyl, heneicosenyl, docosenyl, tricosenyl, tetracosenyl, pentacosenyl, hexacosenyl, heptacosenyl, octacosenyl, nonacosenyl and triacontenyl groups; a cycloalkyl group having 5 to 7 carbon atoms, such as cyclopentyl, cyclohexyl and cycloheptyl groups; an alkylcycloalkyl group having 6 to 11 carbon atoms, of which the cycloalkyl group may possess an alkyl substituent at any position, such as methylcyclopentyl, dimethylcyclopentyl, methylethylcyclopentyl, diethylcyclopentyl, methylcyclohexyl, dimethylcyclohexyl, methylethylcyclohexyl, diethylcyclohexyl, methylcycloheptyl, dimethylcycloheptyl, methylethylcycloheptyl and diethylcycloheptyl groups; an aryl group such as phenyl and naphtyl groups; an alkylaryl group having 7 to 18 carbon atoms, of which the alkyl group may be straight or branched and of which the aryl group may possess an alkyl substituent at any position, such as tolyl, xylyl, ethylphenyl, propylphenyl, butylphenyl, pentylphenyl, hexylphenyl, heptylphenyl, octylphenyl, nonylphenyl, decylphenyl, undecylphenyl and dodecylphenyl groups; and an arylalkyl group having 7 to 12 carbon atoms, of which the alkyl group may be straight or branched, such as benzyl, phenylethyl, phenylpropyl, phenylbutyl, phenylpentyl and phenylhexyl groups.

Because of their good friction characteristics in a wet type clutch, preferred aliphatic monoamines or alkyleneoxide adducts thereof are those of formula (54) wherein $R^{148}$ and $R^{149}$ are each independently hydrogen or an alkyl group having 1 to 6 carbon atoms, and f=g=0, and alkyleneoxide adducts of aliphatic monoamines of formula (54) wherein both $R^{148}$ and $R^{149}$ are hydrogen, and f and g are each independently an integer of 0 to 6 and f+g=1 to 6.

Because of the capability of providing a wet type clutch with good friction characteristics, preferred aliphatic polyamines are those of formula (55) wherein $R^{152}$ and $R^{153}$ are each independently hydrogen or an alkyl group having 1 to 6 carbon atoms.

Because of the capability of providing a wet type clutch with good friction characteristics, preferred imidazoline compounds are those of formula (56) wherein $R^{156}$ is hydrogen or an alkyl group having 1 to 6 carbon atoms.

Derivatives of amine compounds referred to as (E-1) may be (i) an acid-modified compound obtained by allowing the above-described amine compound of formula (54), (55) or (56) to react with monocarboxylic acid (aliphatic acid) having 2 to 30 carbon atoms or polycarboxylic acid having 2 to 30 carbon atoms, such as oxalic acid, phthalic acid, trimellitic acid, and pyromellitic acid so as to neutralize the whole or part of the remaining amino and/or imino groups; (ii) a boron-modified compound obtained by allowing the above-described amine compound of formula (54), (55) or (56) to react with boric acid so as to neutralize the whole or part of the remaining amino and/or imino groups; (iii) a salt of phosphate obtained by allowing the above-described amine compound of formula (54), (55) or (56) to react with acid phosphate or acid phosphite each having in its molecules one or two hydrocarbon groups having 1 to 30 carbon atoms but no hydrocarbon group having 31 or more carbon atoms and having at least one hydroxyl group so as to neutralize the whole or part of the remaining amino or imino groups; (iv) an alkyleneoxide adduct of an amine compound obtained by allowing the amine compound of formula (55) or (56) to react with an alkylene oxide such as ethylene oxide and propylene oxide; and (v) a modified product of an amine compounds obtained by subjecting an amine compound to two or more of the aforesaid modifications.

In view of the capability to provide an excellent friction characteristics in a wet clutch, specific examples of the amine compound (E-1) and derivatives thereof are amine compounds such as lauryl amine, lauryl diethylamine, lauryl diethanolamine, dodecyldipropanolamine, palmitylamine, stearylamine, stearyltetraethylenepentamine, oleylamine, oleylpropylenediamine, oleyldiethanolamine, N-hydroxyethyloleylimidazolyne; alkyleneoxide adducts of these amine compounds; salts of these amine compounds and acid phosphate such as di-2-ethylhexylphosphate or acid phosphite such as 2-ethylhexylphosphite; a boric acid-modified product of these amine compounds, alkyleneoxide adducts of these amine compounds or phosphites of these amine compounds; and mixtures thereof.

Specific examples of the phosphorus compound (E-2) are phosphates represented by formula (57) below and phosphites represented by formula (58) below

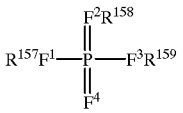

(57)

and

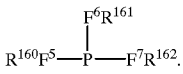

(58)

In formula (57), $R^{157}$ is an alkyl or alkenyl group having 6 to 30, 9 to 24 carbon atoms, $R^{158}$ and $R^{159}$ are each independently hydrogen or a hydrocarbon group having 1 to 30 carbon atoms, $F^1$, $F^2$, $F^3$, and $F^4$ are each independently oxygen or sulfur, provided that at least one of $F^1$, $F^2$, $F^3$, and $F^4$ is oxygen.

In formula (58), $R^{160}$ is analkyloralkenyl group having 6 to 30, preferably 9 to 24 carbon atoms, $R^{161}$ and $R^{162}$ are each independently hydrogen or a hydrocarbon group having 1 to 30 carbon atoms, $F^5$, $F^6$, and $F^7$ are each independently oxygen or sulfur provided that at least one of $F^5$, $F^6$, and $F^7$ is oxygen.

The alkyl and alkenyl group for $R^{157}$ and $R^{160}$ may be straight or branched ones having 6 to 30, preferably 9 to 24 carbon atoms.

Departures from the above-specified range of carbon number would cause a deterioration in the friction characteristics of a wet clutch.

Specific examples of the alkyl and alkenyl groups are the above-described various alkyl and alkenyl groups among which preferred are straight or branched alkyl and alkenyl groups having 12 to 18 carbon atoms, such as laulyl, myristyl, palmityl, stearyl, and oleyl groups in view of the capability of providing the resulting traction drive fluid with an excellent friction characteristics for a wet-type clutch.

Specific examples of the groups for $R^{158}$, $R^{159}$, $R^{161}$, and $R^{162}$ are hydrogen; a straight or branched alkyl group such as methyl, ethyl, propyl, butyl, pentyl, hexyl, heptyl, octyl, nonyl, decyl, undecyl, dodecyl, tridecyl, tetradecyl, pentadecyl, hexadecyl, heptadecyl, octadecyl, nonadecyl, eicosyl, heneicosyl, docosyl, tricosyl, tetracosyl, pentacosyl, hexacosyl, heptacosyl, octacosyl, nonacosyl and triacontyl groups; a straight or branched alkenyl group, the position of which the double bond may vary, butenyl, pentenyl, hexenyl, heptenyl, octenyl, nonenyl, decenyl, undecenyl, dodecenyl, tridecenyl, tetradecenyl, pentadecenyl, hexadecenyl, nonadecenyl, eicocenyl, heneicocenyl, dococenyl, tricocenyl, tetracocenyl, pentacocenyl, hexacocenyl, heptacocenyl, octacocenyl, nonacocenyl and triacontenyl groups; a cycloalkyl group having 5 to 7 carbon atoms, such as cyclopentyl, cyclohexyl and cycloheptyl groups; an alkylcycloalkyl group having 6 toll carbon atoms, of which the cycloalkyl group may possess an alkyl substituent at any position, such as methylcyclopentyl, dimethylcyclopentyl, methylethylcyclopentyl, diethylcyclopentyl, methylcyclohexyl, dimethylcyclohexyl, methylethylcyclohexyl, diethylcyclohexyl, methylcycloheptyl, dimethylcycloheptyl, methylethylcycloheptyl and diethylcycloheptyl groups; an aryl group such as phenyl and naphtyl groups; an alkylaryl group having 7 to 18 carbon atoms, of which the alkyl group may be straight or branched and of which the aryl group may possess an alkyl substituent at any position, such as tolyl, xylyl, ethylphenyl, propylphenyl, butylphenyl, pentylphenyl, hexylphenyl, heptylphenyl, octylphenyl, nonylphenyl, decylphenyl, undecylphenyl and dodecylphenyl groups; and an arylalkyl group having 7 to 12 carbon atoms, of which alkyl group may be straight or branched, such as benzyl, phenylethyl, phenylpropyl, phenylbutyl, phenylpentyl and phenylhexyl groups.

In view of the capability of providing the resulting traction drive fluid with excellent friction characteristics for a wet-type clutch, preferred phosphorus compounds as Component (E-2) are acid phosphates represented by formula (57) wherein at least one of $R^{158}$ and $R^{159}$ is hydrogen and acid phosphites represented formula (58) wherein at least one of $R^{161}$ and $R^{162}$ is hydrogen.

Specific examples of the derivatives of the phosphoric compounds also referred to as Component (E-2) are salts obtained by allowing an acid phosphite of formula (57) wherein at least one of $R^{158}$ and $R^{159}$ is hydrogen or an acid phosphite of formula (58) wherein at least one of $R^{161}$ and $R^{162}$ is hydrogen to react with a nitrogen-containing compound such as ammonia or an amine compound having in its molecules only hydrocarbon or hydroxyl-containing groups having 1 to 8 carbon atoms so as to neutralize the whole or part of the remaining acid hydrogen.

Specific examples of such a nitrogen-containing compound are ammonia; an alkylamine, of which the alkyl group may be straight or branched, such as monomethylamine, monoethylamine, monopropylamine, monobutylamine, monopentylamine, monohexylamine, monoheptylamine, monooctylamine, dimethylamine, methylethylamine, diethylamine, methylpropylamine, ethylpropylamine, dipropylamine, methylbutylamine, ethylbutylamine, propylbutylamine, dibutylamine, dipentylamine, dihexylamine, diheptylamine and dioctylamine; an alkanolamine, of which the alkanol group may be straight or branched, such as monomethanolamine, monoethanolamine, monopropanolamine, monobutanolamine, monopentanolamine, monohexanolamine, monoheptanolamine, monooctanolamine, mononononanolamine, dimethanolamine, methanolethanolamine, diethanolamine, methanolpropanolamine, ethanolpropanolamine, dipropanolamine, methanolbutanolamine, ethanolbutanolamine, propanolbutanolamine, dibutanolamine, dipentanolamine, dihexanolamine, diheptanolamine and dioctanolamine; and mixtures thereof.

In view of the capability to provide the resulting traction drive fluid with excellent friction characteristics for a wet-type clutch, particularly preferred phosphorus compounds as Component (E-2) are monolauryl phosphate, dilauryl phosphate, monostearyl phosphate, distearyl phosphate, monooleyl phosphate, dioleyl phosphate, monolauryl phosphate, dilauryl phosphite, monostearyl phosphite, distearyl phosphite, monooleyl phosphite, dioleylphosphite, monolauryl thiophosphate, dilauryl thiophosphate, monostearyl thiophosphate, distearyl thiophosphate, monooleyl thiophosphate, dioleyl thiophosphate, monolauryl thiophosphate, dilauryl thiophosphite, monostearyl thiophosphite, distearyl thiophosphite, monooleyl thiophosphite, dioleyl thiophosphite; amine salts of these phosphate such as mono2-ethylhexylamine salts, phosphite, thiophosphate and thiophosphite; and mixtures thereof.

The fatty acid amide or fatty metal salt referred to as Component (E-3) may be straight or branched and saturated or unsaturated fatty acid but the alkyl group or alkenyl group thereof has 6 to 30, preferably 9 to 24 carbon atoms. Fatty acids having an alkyl or alkenyl group having fewer than 6 or 31 or greater carbon atoms are not preferred because they would cause the deterioration of the friction characteristics for a wet-type clutch.

Specific examples of the fatty acid are straight or branched saturated fatty acids such as heptanoic acid, octanonic acid, nonanoic acid, decanoic acid, undecanoic acid, dodecanoic acid, tridecanoic acid, tetradecanoic acid, pentadecanoic acid, hexadecanoic acid, heptadecanoic acid, octadecanoic acid, nonadecanoic acid, icosanoic acid, henicosanoic acid, docosanoic acid, tricosanoic acid, tetracosanoic acid, pentacosanoic acid, hexacosanoic acid, heptacosanoic acid, octacosanoic acid, nonacosanoic acid and triacontanoic acid; and straight or branched unsaturated fatty acids, the position of which the double bond may vary, such as heptanoic acid, octenoic acid, nonenoic aicd, decenoic acid, undecenoic acid, dodecenoic acid, tridecenoic acid, tetradecenoic acid, pentadecenoic acid, hexadecenoic acid, heptadecenoic acid, octadecenoic acid, nonadecenoic acid, eicosenoic acid, heneicosenoic acid, docosenoic acid, tricosenoic acid, tetracosenoic acid, pentasenoic acid, hexacosenoic acid, heptacosenoic acid, octacosenoic acid, nonacosenoic acid and triacontenoic acid.

In view of the capability of providing excellent friction characteristics for a wet-type clutch, particularly preferred fatty acids are straight fatty acids derived from various types of fats and oils such as lauric acid, myristic acid, palmitic acid, stearic acid and oleic acid and mixtures of straight fatty acid and branched fatty acid obtained by the oxo synthesis.

The fatty acid amide referred to as Component (E-3) may be amides obtained by reacting a nitrogen-containing compound such as ammonia and amine compound having its molecules only hydrocarbon or hydroxyl-containing hydrocarbon groups having 1 to 8 carbon atoms.

Specific examples of such a nitrogen-containing compound are ammonia; an alkylamine, of which the alkyl group may be straight or branched, such as monomethylamine, monoethylamine, monopropylamine, monobutylamine, monopentylamine, monohexylamine, monoheptylamine, monooctylamine, dimethylamine, methylethylamine, diethylamine, methylpropylamine, ethylpropylamine, dipropylamine, methylbutylamine, ethylbutylamine, propylbutylamine, dibutylamine, dipentylamine, dihexylamine, diheptylamine and dioctylamine; and alkanolamine, of which the alkanol group may be straight or branched, such as monomethanolamine, monoethanolamine, monopropanolamine, monobutanolamine, monopentanolamine, monohexanolamine, monoheptanolamine, monooctanolamine, mononononanolamine, dimethanolamine, methanolethanolamine, diethanolamine, methanolpropanolamine, ethanolpropanolamine, dipropanolamine, methanolbutanolamine, ethanolbutanolamine, propanolbutanolamine, dibutanolamine, dipentanolamine, dihexanolamine, diheptanolamine and dioctanolamine.

In view of the capability to provide excellent friction characteristics for a wet-type clutch, specific examples of the fatty acid amides as Component (E-3) are lauric acid amide, lauric acid diethanolamide, lauric monopropanolamide, myristic acid amide, myristic acid diethanolamide, myristic acid monopropanolamide, palmitic acid amide, palmitic acid ethanolamide, palmitic acid monopropanolamide, stearic acid amide, stearic acid diethanolamide, stearic acid monopropanolamide, oleic acid amide, oleic acid diethanolamide, oleic acid monopropanol amide, coconut oil fatty amide, coconut oil fatty acid diethanolamide, coconut oil fatty monopropanolamide, a synthetic mixed fatty amide having 12 to 13 carbon atoms, a synthetic mixed fatty diethanolamide having 12 to 13 carbon atoms, a synthetic mixed fatty monopropanolamide having 12 to 13 carbon atoms, and mixtures thereof.

Specific examples of the fatty metallic acid also referred to as Component (E-3) are an alkaline earth metal salt of any of the above-exemplified fatty acids such as a magnesium salt and a calcium salt or a zinc salt.

In view of the capability to provide excellent friction characteristics for a wet-type clutch, particularly preferred fatty acid metallic salts are calcium laurate, calcium myristate, calcium palmitate, calcium stearate, calcium oleate, coconut oil fatty acid calcium, a synthetic mixed fatty acid calcium having 12 to 13 carbon atoms, zinc laurate, zinc myristate, zinc palmitate, zinc stearate, zinc oleate, coconut oil fatty zinc, a synthetic mixed fatty zinc having 12 to 13 carbon atoms, and mixtures thereof.

Any one or more members arbitrary selected from the above-described Components (E) may be added to a traction drive fluid of the present invention in any suitable amount as long as they do not adversely affect the other performances of the resulting fluid such as oxidation stability. In order to enhance the durability of friction characteristics of the fluid, it is necessary to avoid a deterioration in friction characteristics caused by the deterioration of Component (E). The addition of large amounts of Component (E) is effective in enhancing the durability of the friction characteristics. However, too large amounts of Component (E) would lead to a reduction in static friction coefficient which is required to be high so as to maintain the coupling or engagement of a wet-type clutch. The amount of Component (E) is thus limited to some extent. Therefore, the content of Component (E) is within the range of preferably 0.005–3.0 mass percent, preferably 0.01–2.0 mass percent, based on the total mass of a traction drive fluid.

When there arises a necessity of adding Component (E) in an amount exceeding such a limit so as to improve the durability of friction characteristics, a traction drive fluid of the present invention may be blended with an additive for enhancing friction coefficient, hereinafter referred to as Component (G).

Compound (G) may be exemplified by the following compounds:

(G-1) a compound having the same polar group as those of Component (E) and a lipophilic group which is a hydrocarbon group having fewer than 100 carbon atoms; and (G-2) a nitrogen-containing compound such as succinimide- and succinamide-compounds or a compound obtained by modifying the nitrogen-containing compound with a boron compound such as boric acid or a sulfur compound.

When Components (E) and (G) are used in combination in a traction drive fluid according to the present invention, the content of Component (G) is within the range of preferably 0.1 to 10.0 percent by mass, more preferably 0.5 to 3.0 percent by mass, based on the total mass of a traction drive fluid. The contents of Component (G) less than 0.1 percent by mass would be less effective in increasing static friction coefficient, while those in excess of 10.0 percent by mass would cause the deterioration of flowability at low temperatures and oxidation stability.

A traction drive fluid according to the present invention contains preferably a metallic detergent hereinafter referred to as Component (F). The addition of Component (F) makes it possible to optimize the friction characteristics of a wet-type clutch and restrict a reduction in strength thereof which reduction is caused by pressure being applied repeatedly.

Preferred metallic detergents are basic metallic detergents having a total base number of 20 to 450 mgKOH/g, preferably 50 to 400 mgKOH/g. The term "total base number" used herein denotes a total base number measured by the perchloric acid potentiometric titration method in accordance with section 7 of JIS K2501 "Petroleum products and lubricants-Determination of neutralization number".

Metallic detergents having a total base number of less than 20 mgKOH/g would be less effective in inhibiting a wet-type clutch from being reduced in strength due to the repeated compression applied thereto, while those having a total base number in excess of 450 mgKOH/g would be unstable in structure, leading to a deterioration in the storage stability of the resulting composition.

Component (F) may be one or more member selected from the following metal detergents:

(F-1) alkaline earth metal sulfonates of 20–450 mgKOH/g in total base number;

(F-2) alkaline earth metal phenates of 20–450 mgKOH/g in total base number; and (F-3) alkaline earth metal salicylates of 20–450 mgKOH/g in total base number.

Specific examples of alkaline earth metal sulfonates referred to as Component (F-1) are alkaline earth metal salts of alkyl aromatic sulfonic acid obtained by sulfonating an alkyl aromatic compound having a molecular weight of 100 to 1,500, preferably 200 to 700. Particularly preferred are magnesium sulfonates and/or calcium sulfonates.

The petroleum sulfonic acid may be mahogany acid obtained by sulfonating the alkyl aromatic compound contained in the lubricant fraction of mineral oil or by-produced upon the production of white oil. The synthetic sulfonic acid may be those obtained by sulfonating alkyl benzene having a straight or branched alkyl group, which may be by-produced from a plant for producing alkyl benzene used as material of detergents, or sulfonating dinonylnaphthalene. Although not restricted, there may be used fuming sulfuric acid and sulfuric acid as a sulfonating agent.

Specific examples of alkaline earth metal phenates referred to as Component (F-2) are alkaline earth metal salts of alkylphenol having at least one straight or branched alkyl group of 4 to 30, preferably 6 to 18 carbon atoms, alkylphenolsulfide obtained by reacting the alkylphenol with elementary sulfur or a product resulting from Mannich reaction of the alkylphenol and formaldehyde. Particularly preferred are magnesium phenates and/or calcium phenates.

Specific examples of alkaline earth metal salicylates referred to as Component (F-3) are alkaline earth metal salts of alkyl salicylic acid having at least one straight or branched alkyl group of 4 to 30, preferably 6 to 18 carbon atoms. Particularly preferred are magnesium salicylates and/or calcium salicylates.

Components (F-1), (F-2), and (F-3), as long as they have a total base number of 20 to 450 mgKOH/g, may be (i) a neutral salt produced directly by reacting a compound such as alkyl aromatic sulfonic acid, alkylphenol, alkylphenol sulfide and the Mannich reaction product of alkylphenol, and alkyl salicylic acid with an alkaline earth metal oxide or hydroxide of magnesium and/or calcium, or produced indirectly by converting such a compound into an alkali metal salt such as sodium salt or potassium salt and then substituting the alkali metal salt with an alkaline earth metal salt; (ii) a basic salt obtained by heating such a normal salt and an excess amount of an alkaline earth metal salt or an alkaline earth metal hydroxide or oxide in the presence of water, and (ii) overbased salts obtained by reacting the neutral salt with an alkaline earth metal oxide or hydroxide in the presence of carbon dioxide.

These reactions may be carried out in a solvent, for example, an aliphatic hydrocarbon solvent such as hexane, an aromatic hydrocarbon solvent such as xylene and a light lubricant base oil. Commercially available metallic detergents are usually diluted with a light lubricant base oil. It is preferred to use metallic detergents containing metal in an amount of 1.0 to 20 percent by mass, preferably 2.0 to 16 percent by mass.

Although not restricted, the content of Component (F) in a traction drive fluid according to the present invention is within the range of 0.01 to 5.0 percent by mass, preferably 0.05 to 4.0 percent by mass, based on the total mass of the fluid. Contents less than 0.05 mass percent would be less effective in inhibiting a wet-type clutch from being reduced in strength due to repeatedly applied compression, while contents greater than 5.0 mass percent would reduce the oxidation stability of the resulting composition.

The above-described Components (C), (D), (E) and (F) can provide a traction drive fluid according to the present invention with wear resistance, oxidation stability and detergency needed for a hydraulic controlling mechanism and friction characteristics for a wet-type clutch needed for a friction characteristics controlling mechanism as well as the capability to provide the wet-type clutch with strength against repeatedly applied compression force. For the purpose of further enhancing these capabilities and improving the resistance to corrosiveness of nonferrous metals such as copper materials as well as durability of resins such as nylon, a traction drive fluid according to the present invention may be added with oxidation inhibitors, extreme pressure agents, corrosion inhibitors, rubber swelling agents, antifoamers and colorants. These additives may be used singlely or in combination.

Oxidation inhibitors may be phenol-based or amine-based compounds such as alkylphenols such as 2-6-di-tert-butyl-4-methylphenol, bisphenols such as methylene-4,4-bisphenol(2,6-di-tert-butyl-4-methylphenol), naphtylamines such as phenyl-α-naphtylamine, dialkyldiphenylamines, zinc dialkyldithiophosphates such as zinc di-2-ethylhexyldithiophosphate, esters of 3,5-di-tert-butyl-4-hydroxyphenyl fatty acid (propionic acid) with a mono- or poly-hydric alcohol such as methanol, octadecanol, 1,6 hexanediol, neopentyl glycol, thiodiethylene glycol, triethylene glycol or pentaerythritol.

One or more of these compounds is preferably added in an amount of 0.01 to 5.0 percent by mass based on the total mass of a traction drive fluid.

Extreme pressure additives may be sulfur-containing compounds such as disulfides, olefin sulfides and sulfurized fats and oils. One or more of these compounds is preferably added in an amount of 0.1 to 5.0 percent by mass based on the total mass of a traction drive fluid.

Corrosion inhibitors may be benzotriazoles, tolyltriazoles, thiodiazoles and imidazoles. One or more of these compounds is preferably added in an amount of 0.01 to 3.0 percent by mass based on the total mass of a traction drive fluid.

Antifoamers may be silicones such as dimethylsilicone and fluorosilicone. One or more of these compounds is preferably added in an amount of 0.001–0.05 percent by mass based on the total mass of a traction drive fluid.

Colorants may be added in an amount of 0.001–1.0 mass percent.

APPLICABILITY IN THE INDUSTRY

As described above, a traction drive fluid according to the present invention has an excellent driving force transmitting capability and can posses the capabilities as a fluid for a hydraulic controlling mechanism and a friction characteristics controlling mechanism for a wet-type clutch which the conventional commercially available traction drive fluid do not have. Therefore, a traction dive fluid according to the present invention can satisfactorily exhibit its performances as a traction drive fluid for an automobile.

The present invention will be further described by way of the following examples which are provided for illustrative purposes only.

EXAMPLES

Example 1

Fluids 1 and 2 according to the present invention were prepared by the following procedures.

Fluid 1

799 g (about 7.0 moles) of 1-methylcyclohexanol and 708 g (about 7.0 moles) of triethylamine were charged into a 3 L 4-necked flask and cooled to below 5° C. in an ice bath, followed by the addition of 1026 g (about 7.0 moles) of cyclohexanoic carboxylic acid chloride in droplets over 5 hours. Thereafter, the mixture was reacted for 2 hours. The reaction solution was transferred into a 5 L separatory funnel to remove excess triethylamine. 1 L of pure water was then added to the solution 5 times so as to dissolve and remove the by-products and other impurities. The resulting solution was made acid with diluted hydrochloric acid and then to the aqueous phase thereof was added 1 L of pure water until it was made neutral. After the separation of the aqueous phase, the remaining was dehydrated with sodium sulfate anhydride, followed by removal of the light fractions under at a temperature of 100° C. and pressure of 0.4 kPa (3 mmHg) thereby obtaining about 1180 g of 1-methylcyclohexanolcyclohexanoic carboxylic acid ester represented by the formula:

[Fluid 2]

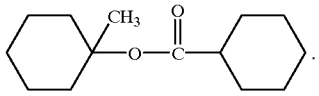

940 g (about 12.0 mole) of benzene was charged into a 3 L 4-necked flask and cooled to below 5° C. in an ice bath, followed by the addition of 1080 g (about 10.5 moles) of 95 concentrated sulfuric acid. The mixture was further cooled until the interior of the reaction vessel was cooled to below 5° C., followed by the addition of a mixture of 550 g (about 4.8 moles) of 2-methylcyclohexanol and 400 g (about 3.8 moles) of benzene in droplets over 5 hours. Thereafter, the reaction was continued for 2 hours. The reaction solution was transferred into a 5 L separatory funnel to separate the sulfuric acid phase. 1 L of pure water was then added to the solution 5 times so as to dissolve and remove the by-products and other impurities. The resulting solution was made alkali with 1% aqueous solution of sodium hydroxide, followed by the addition of 1 L of water until the aqueous phase was made neutral. After the separation of the aqueous phase, the remaining was dehydrated with sodium sulfate anhydride, followed by removal of the light fractions and the excess benzene under at a temperature of 100° C. and pressure of 0.4 kPa (3 mmHg) thereby obtaining about 900 g of crude 1-phenyl-1-methylcyclohexane. This was subjected to vacuum distillation thereby obtaining 800 g of a fraction having a boiling point of 119.7 to 120.5° C. at a pressure of 0.4 kPa (3 mmHg). The fraction was charged into a 2 L autoclave, followed by the addition of 8 g of a nickel-based hydrogenating catalyst. The reaction was carried out at a temperature of 150° C. and at a maximum pressure of $6.86\times10^6$ Pa (70 kg/cm$^2$) until the absorption of hydrogen did not occurred. Thereafter, the catalyst was removed thereby obtaining about 820 g of the targeted product represented by the formula

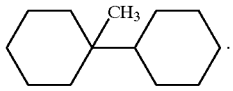

Fluids 3 and 4 were also synthesized in accordance with the similar procedures:

[Fluid 3]

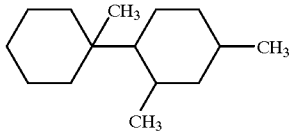

-continued

[Fluid 4]

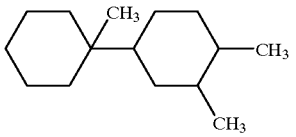

The traction coefficient and low-temperature viscosity at −30 C., i.e., Brookfield viscosity of Fluids 1 through 4, cyclohexanolcyclohexanoic carboxylic acid ester (Comparative fluid 1), and isobuten oligomer (Comparative fluid 2, number average molecular weight (MN):350) were measured and the results are shown in Table 1. The traction coefficient was measured using a four-roller traction coefficient test apparatus under the following conditions:

Peripheral speed: 5.23 m/s

Oil temperature: 60° C.

Maximum Hertzian contact pressure: 1.10 Gpa

Slip ratio: 2%.

TABLE 1

| Sample | Traction Coefficient | Brookfield Viscosity @ −30° C. mPa · s |
|---|---|---|
| Fluid 1 | 0.078 | 870 |
| Fluid 2 | 0.079 | 100 |
| Fluid 3 | 0.086 | 1,200 |
| Fluid 4 | 0.084 | 310 |
| Comparative Fluid 1 | 0.067 | 400 |
| Comparative Fluid 2 | 0.071 | 4,500 |

Next, various mixed fluids were prepared using Fluids 1 and 4, Comparative fluid 2, and 2-methyl-2,4-dicyclohexylpentane (Comparative fluid 3) which has been used in machines for industrial use and reputed having high traction coefficient, in accordance with the formulation shown in Table 2. The traction coefficient and Brookfield viscosity at −30° C. of each of the resulting fluids were measured. The results were also shown in Table 2.

TABLE 2

| | Composition (mass %) | | | | | Brookfield |
|---|---|---|---|---|---|---|
| | Fluid 1 | Fluid 4 | Comparative Fluid-2 | Comparative Fluid-3 | Traction Coefficient | Viscosity @ −30° C. mPa · s |
| Comparative Fluid 3 | — | — | — | 100 | 0.099 | 30,000 |
| Fluid 5 | 10 | — | — | 90 | 0.097 | 20,000 |
| Fluid 6 | — | 10 | — | 90 | 0.098 | 17,000 |

TABLE 2-continued

| | Composition (mass %) | | | | | Brookfield |
|---|---|---|---|---|---|---|
| | Fluid 1 | Fluid 4 | Comparative Fluid-2 | Comparative Fluid-3 | Traction Coefficient | Viscosity @ −30° C. mPa · s |
| Comparative Fluid 4 | — | — | 10 | 90 | 0.096 | 24,000 |
| Fluid 7 | 50 | — | — | 50 | 0.089 | 4,200 |
| Fluid 8 | — | 50 | — | 50 | 0.092 | 2,200 |
| Comparative Example 5 | — | — | 50 | 50 | 0.085 | 11,000 |

As apparent form the results in Table 2, the low temperature viscosity can be significantly improved by mixing the fluid of the present invention with 2-methyl-2,4-dicyclohexylpentane (Comparative fluid-2) which is the existing traction drive fluid, with the traction coefficient almost unchanged.

Fluids 9–14 were prepared by mixing Fluids 1 and 4 with polymethacrylate (PMA) having a number average molecular weight of 18,000, polyisobutylene (PIB) having a number average molecular weight of 2,700, and a hydrogenated product of a copolymer of ethylene-α-olefin (OCP) as viscosity index improvers (B). Fluids 9–14 and Fluids 1 and 4 were measured in kinematic viscosity at 100° C. and low temperature viscosity at 30° C. (BF viscosity) and traction coefficient. The results were shown in Table 3.

TABLE 3

| | Composition (mass %) | | | | | Kinematic Viscosity @ 100° C. | Brookfield Viscosity @ −30° C. | Traction |
|---|---|---|---|---|---|---|---|---|
| | | | Component B | | | | | |
| | Fluid 1 | Fluid 4 | PMA | PIB | OCP | $mm^2/s$ | mPa · s | Coefficient |
| Fluid 1 | 100 | — | — | — | — | 2.2 | 870 | 0.078 |
| Fluid 9 | 91.6 | — | 8.4 | — | — | 5.0 | 1,200 | 0.072 |
| Fluid 10 | 92.4 | — | — | 7.6 | — | 5.0 | 2,100 | 0.077 |
| Fluid 11 | 96.8 | — | — | — | 3.2 | 5.0 | 1,400 | 0.076 |
| Fluid 4 | — | 100 | — | — | — | 1.8 | 310 | 0.084 |
| Fluid 12 | — | 90.4 | 9.6 | — | — | 5.0 | 400 | 0.076 |
| Fluid 13 | — | 91.2 | — | 8.8 | — | 5.0 | 850 | 0.083 |
| Fluid 14 | — | 96.5 | — | — | 3.5 | 5.0 | 570 | 0.082 |

As apparent from the results in Table 3, the viscosity at high temperatures can be significantly increased by mixing Component (B) without changing the traction coefficient and low temperature viscosity too much.

Fluids 15–21 were prepared by mixing Fluid 1 with (B) a viscosity index improver, (C) an ashless dispersant and (D) a phosphorus-containing additive in accordance with the formulations indicated in Table 4. Each of Fluids 15–21 was evaluated in anti-wear characteristics and oxidation stability, respectively. The results were shown in Table 4.

The anti-wear characteristics were evaluated by Shell four ball test conducted under the conditions of 80° C., 1,800 rpm, 294 N (30 kgf) for 60 minutes in accordance with ASTM D 2266 so as to measure the size of the scar caused by wear on the steel ball. The oxidation stability was evaluated by conducting an oxidation test under the conditions of 150° C. and 96 hours in accordance with JIS K 2514 "Lubricating Oil-Determination of oxidation stability".

TABLE 4

| Composition (mass %) | | Fluid 15 | Fluid 16 | Fluid 17 | Fluid 18 | Fluid 19 | Fluid 20 | Fluid 21 |
|---|---|---|---|---|---|---|---|---|
| Base Oil | Fluid 1 | 97.35 | 97.35 | 93.65 | 88.45 | 99.5 | 97.0 | 99.35 |
| Component B | OCP | — | — | 3.2 | — | — | — | — |
| | PMA | — | — | — | 8.4 | — | — | — |
| Component C | Ashless Dispersant A | 1.5 | — | 1.5 | 1.5 | — | 1.5 | — |
| | Ashless Dispersant B | 1.0 | 2.5 | 1.0 | 1.0 | — | 1.0 | — |
| Component D | Phosphorus-Containing Additive A | 0.15 | 0.15 | 0.15 | 0.15 | — | — | 0.15 |
| Other | Oxidation Inhibitor A | — | — | 0.5 | 0.5 | 0.5 | 0.5 | 0.5 |
| Shell Four Ball Test Wear-scar Size, mm | | — | — | 0.48 | 0.48 | — | 1.96 | 0.65 |
| Oxidation Stability Test | | | | | | | | |
| Total Acid Value Increase, mg KOH/g | | 0.49 | 0.50 | 0.55 | 0.53 | 0.52 | — | 1.35 |
| Lacquer Rating (deposit) | | none | none | none | none | medium | — | dark |
| n-pentane insoluble, mass % | | 0.00 | 0.00 | 0.00 | 0.00 | 0.21 | — | 0.56 |

(1) OCP: same as the one shown in Table 3
(2) PMA: same as the one shown in Table 3
(3) Ashless dispersant A: alkenylsuccinimide (bis-type, number average molecular weight 5,500)
(4) Ashless Dispersant B: borated succinimide (mono-type, number average molecular weight 4,500)
(5) Phosphorus-containing additive A: diphenylhydrodienephosphite
(6) Oxidation Inhibitor A: bisphenol- based Fluids 22–28 were prepared by mixing Fluid 4 instead of Fluid 1 with (B) a viscosity index improver, (C) an ashless dispersant, and (D) a phosphorus-containing additive, in accordance with the formulations indicated in Table 5. Fluids 22–28 were also evaluated in anti-wear characteristics and oxidation stability with the same procedures as described above. The results were shown in Table 5.

TABLE 5

| Composition (mass %) | | Fluid 22 | Fluid 23 | Fluid 24 | Fluid 25 | Fluid 26 | Fluid 27 | Fluid 28 |
|---|---|---|---|---|---|---|---|---|
| Base Oil | Fluid 4 | 97.35 | 97.35 | 93.35 | 87.25 | 99.5 | 97.0 | 99.35 |
| Component B | OCP | — | — | 3.5 | — | — | — | — |
| | PMA | — | — | — | 9.6 | — | — | — |
| Component C | Ashless Dispersant A | 1.5 | — | 1.5 | 1.5 | — | 1.5 | — |
| | Ashless Dispersant B | 1.0 | 2.5 | 1.0 | 1.0 | — | 1.0 | — |
| Component D | Phosphorus-Containing Additive A | 0.15 | 0.15 | 0.15 | 0.15 | — | — | 0.15 |
| Other | Oxidation Inhibitor A | — | — | 0.5 | 0.5 | 0.5 | 0.5 | 0.5 |
| Shell Four Ball Test Wear-scar Size, mm | | — | — | 0.45 | 0.42 | — | 1.65 | 0.54 |
| Oxidation Stability Test | | | | | | | | |
| Total Acid Value Increase, mg KOH/g | | 0.52 | 0.51 | 0.49 | 0.45 | 0.62 | — | 1.21 |
| Lacquer Rating (deposit) | | none | none | none | none | medium | — | Dark |
| n-pentane insoluble, mass % | | 0.00 | 0.00 | 0.00 | 0.00 | 0.28 | — | 0.51 |

(1) OCP: same as the one shown in Table 3
(2) PMA: same as the one shown in Table 3
(3) Ashless dispersant A: same as the one shown in Table 4
(4) Ashless Dispersant B: same as the one shown in Table 4
(5) Phosphorus-containing additive A: same as the one shown in Table 4
(6) Oxidation Inhibitor A: the same as the one shown in Table 4

As apparent from the results in Tables 4 and 5, the blend of (C) an ashless dispersant and (D) a phosphorus-containing additive in combination makes it possible to anti-abrasion characteristics, oxidation stability, and detergency which are necessary for a traction drive fluid.

Fluids 29–34 were prepared by mixing Fluid 1 with (B) a viscosity index improver, (C) an ashless dispersant, (D) a phosphorus-containing additive, (E) a friction modifier, and (F) a metallic detergent in accordance with the formulations shown in Table 6. The dependence of friction coefficient on slipping speed of each Fluids 29–34 and Fluids 1 and 15 was measured using a low velocity slip testing machine in accordance with JASO M349-95 "Automatic transmission fluid-determination of shudder inhibition capability" under the following conditions. The dependence of friction coefficient on slipping speed was expressed by the value of ($\mu$(1 rpm)/$\mu$(50 rpm). If the value exceeds 1, the dependence was graded as positive gradient. If the value is less than 1, the dependence was graded as negative gradient.

Low Velocity Slipping Test (1) Test conditions: JASO M349-95 "Automatic transmission fluid-determination of shudder inhibition capability"

(2) Oil amount: 0.2 L (3) Oil temperature: 80° C., (4) Surface pressure: 0.98 Mpa Fluids 35–40 was prepared by mixing Fluid 4 instead of Fluid 1 with (B) a viscosity index improver, (C) an ashless dispersant, (D) a phosphorus-containing additive, (E) a friction modifier, and (F) a metallic detergent in accordance with the formulations shown in Table 7. Fluids 35–40 and Fluids 4 and 22 were subjected to the same low velocity slipping test. The results were also shown in Table 7.

TABLE 6

| Composition (mass %) | | Fluid 29 | Fluid 30 | Fluid 31 | Fluid 32 | Fluid 33 | Fluid 34 | Fluid 1 | Fluid 15 |
|---|---|---|---|---|---|---|---|---|---|
| Base oil | Fluid 1 | 99.85 | 99.85 | 99.5 | 99.5 | 93.5 | 88.3 | 100 | 97.35 |
| Component B | OCP | — | — | — | — | 3.2 | — | — | — |
| | PMA | — | — | — | — | — | 8.4 | — | — |
| Component C | Ashless Dispersant A | — | — | — | — | 1.5 | 1.5 | — | 1.5 |
| | Ashless Dispersant B | — | — | — | — | 1.0 | 1.0 | — | 1.0 |
| Component D | Phosphorus-containing Additive A | — | — | — | — | 0.15 | 0.15 | — | 0.15 |
| Component E | Friction Modifier A | 0.15 | — | — | — | 0.15 | 0.15 | — | — |
| | Friction Modifier B | — | 0.15 | — | — | — | — | — | — |
| Component F | Mg Sulfonate A | — | — | 0.5 | — | — | — | — | — |
| | Ca Sulfonate B | — | — | — | 0.5 | 0.5 | 0.5 | — | — |
| Low Velocity Slippage Test $\mu$(1 rpm)/$\mu$(50 rpm) | | 0.89 Positive Gradient | 0.91 Positive Gradient | 0.93 Positive Gradient | 0.95 Positive Gradient | 0.87 Positive Gradient | 0.84 Positive Gradient | 1.56 Negative Gradient | 1.25 Negative Gradient |

(1) OCP: same as the one shown in Table 3
(2) PMA: same as the one shown in Table 3
(3) Ashless dispersant A: same as the one shown in Table 4
(4) Ashless Dispersant B: same as the one shown in Table 4
(5) Phosphorus-containing additive A: same as the one shown in Table 4
(6) Friction modifier: ethoxylated oleylamine

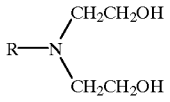

(R: oleyl group)
(7) Friction Modifier B: oleylamine
(8) Mg sulfonate A: petroleum-based, total base number (perchloric method): 300 mg KOH/g Mg content: 6.9 percent by mass
(9) Ca sulfonate A: petroleum-based, total base number (perchloric method): 300 mg KOH/g Ca content: 12.0 percent by mass

TABLE 7

| Composition (mass %) | | Fluid 35 | Fluid 36 | Fluid 37 | Fluid 38 | Fluid 39 | Fluid 40 | Fluid 4 | Fluid 22 |
|---|---|---|---|---|---|---|---|---|---|
| Base oil | Fluid 4 | 99.85 | 99.85 | 99.5 | 99.5 | 93.2 | 87.1 | 100 | 97.35 |
| Component B | OCP | — | — | — | — | 3.5 | — | — | — |
| | PMA | — | — | — | — | — | 9.6 | — | — |
| Component C | Ashless Dispersant A | — | — | — | — | 1.5 | 1.5 | — | 1.5 |
| | Ashless Dispersant B | — | — | — | — | 1.0 | 1.0 | — | 1.0 |

TABLE 7-continued

| Composition (mass %) | | Fluid 35 | Fluid 36 | Fluid 37 | Fluid 38 | Fluid 39 | Fluid 40 | Fluid 4 | Fluid 22 |
|---|---|---|---|---|---|---|---|---|---|
| Component D | Phosphorus-containing Additive A | — | — | — | — | 0.15 | 0.15 | — | 0.15 |
| Component E | Friction Modifier A | 0.15 | — | — | — | 0.15 | 0.15 | — | — |
| | Friction Modifier B | — | 0.15 | — | — | — | — | — | — |
| Component F | Mg Sulfonate A | — | — | 0.5 | — | — | — | — | — |
| | Ca Sulfonate B | — | — | — | 0.5 | 0.5 | 0.5 | — | — |
| Low Velocity Slippage Test $\mu$(1 rpm)/$\mu$(50 rpm) | | 0.91 Positive Gradient | 0.92 Positive Gradient | 0.95 Positive Gradient | 0.97 Positive Gradient | 0.89 Positive Gradient | 0.89 Positive Gradient | 1.82 Negative Gradient | 1.35 Negative Gradient |

(1) OCP: same as the one shown in Table 3

(2) PMA: same as the one shown in Table 3

(3) Ashless dispersant A: same as the one shown in Table 4

(4) Ashless Dispersant B: same as the one shown in Table 4

(5) Phosphorus-containing additive A: same as the one shown in Table 4

(6) Friction modifier A: same as the one shown in Table 6

(7) Friction Modifier B: the same as the one shown in Table 6

(8) Mg sulfonate A: the same as the one shown in Table 6

(9) Ca sulfonate A: the same as the one shown in Table 6

As apparent from the results in Tables 6 and 7, the blend of (E) a friction modifier and/or (F) a metallic detergent with a traction drive fluids makes it possible to optimize friction characteristics for a wet clutch such as a variable-speed clutch and a slip-lock-up clutch.

Example 2

Fluid 41 according to the present invention was prepared by the following procedures.

(Fluid 41)

1,320 g (about 10.0 mole) of tetralin were charged into a 3 L 4-necked flask and cooled to below 5° C. in an ice bath, followed by the addition of 940 g (about 9.5 moles) of 95 concentrated sulfuric acid. The mixture was further cooled until the interior of the reaction vessel was cooled to below 5° C., followed by the addition of a mixture of 550 g (about 4.8 moles) of 2-methylcyclohexanol and 340 g (about 3.0 moles) of tetralin in droplets over 5 hours. Thereafter, the reaction was continued for 2 hours. The reaction solution was transferred into a 5 L separatory funnel to separate thesulfuric acid phase. 1 L of pure water was then added to the solution 5 times so as to dissolve and remove the by-products and other impurities. The resulting solution was made alkali with 1% aqueous solution of sodium hydroxide, followed by the addition of 1 L of water until the aqueous solution was made neutral. After the separation of the aqueous phase, the remaining was dehydrated with sodium sulfate anhydride, followed by removal of the light fractions at a temperature of 100° C. and pressure of 0.4 kPa (3 mmHg). The resulting product was subjected to vacuum distillation thereby obtaining 800 g of a fraction having a boiling point of 119.7 to 120.5° C. at a pressure of 0.4 kPa (3 mmHg). The fraction was charged into a 2 L autoclave, followed by the addition of 8 g of a nickel-based hydrogenating catalyst. The reaction was carried out at a temperature of 150° C. and at a maximum pressure of $6.86\times10^6$ Pa (70 kg/cm$^2$) until the absorption of hydrogen did not occurred. Thereafter, the catalyst was removed thereby obtaining about 865 g of Fluid 41 which is a mixture of a compound represented by formula (59) and a compound represented by formula (60). The ratio of the compound of formula (59) to the compound of formula (60) was 98:2 percent by mass.

(59)

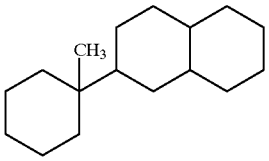

(60)

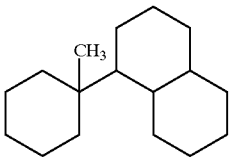

The traction coefficient and Brookfiled viscosity at −30° C., of Fluids 41 and 2-methyl-2,4-dicyclohexylpentane (Comparative fluid 3) were measured and the results are shown in Table 8.

TABLE 8

| Sample | Traction Coefficient | Brookfield Viscosity @ −30° C. mPa · s |
|---|---|---|
| Fluid 41 | 0.104 | 53,000 |
| Comparative fluid 3 | 0.099 | 30,000 |

Next, various mixed fluids were prepared using Fluid 41 and 4, Comparative fluid 3, and 1-(3,4-dimethylcyclohexyl)-1-methylcyclohexane, and isobutene oligomer (Comparative fluid 2), in accordance with the formulation shown in Table 9. The traction coefficient and Brookfield viscosity at −30° C. of each of the resulting fluids were measured. The results were also shown in Table 9.

TABLE 9

| | Composition (mass %) | | | | | Brookfield |
|---|---|---|---|---|---|---|
| | Fluid 41 | Comparative Fluid-3 | Fluid 4 | Comparative Fluid-2 | Traction Coefficient | Viscosity @ −30° C. mPa · s |
| Fluid 41 | 100 | — | — | — | 0.104 | 53,000 |
| Comparative Fluid 3 | — | 100 | — | — | 0.099 | 30,000 |
| Fluid 42 | 90 | — | 10 | — | 0.102 | 27,000 |
| Fluid 4 | — | — | 100 | — | 0.084 | 310 |
| Fluid 43 | 65 | — | — | 35 | 0.092 | 15,000 |
| Comparative Fluid 4 | — | 70 | — | 30 | 0.090 | 15,000 |
| Comparative Fluid 2 | — | — | — | 100 | 0.071 | 4,500 |

Fluid 41 according to the present invention can be significantly improved in low temperature viscosity characteristics but not almost changed in traction coefficient by being blended with a synthetic oil having a molecular weight of 150 to 800. The effects achieved by Fluid 41 is much higher than those achieved by 2-methyl-2,4-dicyclohexylpentane (Comparative fluid 3) which is a conventional traction fluid.

Fluids 44 through 46 were prepared by mixing Fluid 41 with polymethacrylate (PMA), polyisobutylene (PIB), and a hydrogenated product of a copolymer of ethylene-α-olefin (OCP) as viscosity index improvers (B). Fluids 44–46 and Fluids 41 were measured in kinematic viscosity at 100° C. and low temperature viscosity at 30° C. (BF viscosity) and traction coefficient. The results were shown in Table 10.

TABLE 10

| | Composition (mass %) | | | | Kinematic Viscosity @ 100° C. | Brookfield Viscosity @ −30° C. | Traction |
|---|---|---|---|---|---|---|---|
| | | Component B | | | | | |
| | Fluid 41 | PMA | PIB | OCP | $mm^2/s$ | mPa · s | Coefficient |
| Fluid 41 | 100 | — | — | — | 3.7 | 53,000 | 0.104 |
| Fluid 44 | 96.1 | 3.9 | — | — | 5.0 | 73,000 | 0.100 |
| Fluid 45 | 96.5 | — | 3.5 | — | 5.0 | 128,000 | 0.103 |
| Fluid 46 | 98.5 | — | — | 1.5 | 5.0 | 85,000 | 0.102 |

(1) OCP: same as the one shown in Table 3

(2) PIB: same as the one shown in Table 3

(3) PMA: same as the one shown in Table 3

As apparent from the results in Table 10, the high temperature viscosity can be significantly enhanced by blending (B) a viscosity index improver, without changing the traction coefficient and low temperature viscosity characteristics too much.

Fluids 47–53 were prepared by mixing Fluid 41 with (B) a viscosity index improver, (C) an ashless dispersant, and (D) a phosphorus-containing additive in accordance with the formulation shown in Table 11. Fluids 47–53 were evaluated in anti-abrasion characteristics and oxidation stability. The results were shown in Table 11.

TABLE 11

| Composition (mass %) | | Fluid 47 | Fluid 48 | Fluid 49 | Fluid 50 | Fluid 51 | Fluid 52 | Fluid 53 |
|---|---|---|---|---|---|---|---|---|
| Base Oil | Fluid 41 | 97.35 | 97.35 | 93.65 | 88.45 | 99.5 | 97.0 | 99.35 |
| Component B | OCP | — | — | 3.2 | — | — | — | — |
| | PMA | | | | | | | |
| Component C | Ashless Dispersant A | 1.5 | — | 1.5 | 1.5 | — | 1.5 | — |
| | Ashless Dispersant B | 1.0 | 2.5 | 1.0 | 1.0 | — | 1.0 | — |
| Component D | Phosphorus-Containing Additive A | 0.15 | 0.15 | 0.15 | 0.15 | — | — | 0.15 |
| Other | Oxidation Inhibitor A | — | — | 0.5 | 0.5 | 0.5 | 0.5 | 0.5 |
| Shell Four Ball Test Wear-scar Size, mm | | — | — | 0.42 | 0.42 | — | 1.58 | 0.53 |
| Oxidation Stability Test | | | | | | | | |
| Total Acid Value Increase, mg KOH/g | | 0.49 | 0.45 | 0.52 | 0.47 | 0.62 | — | 1.29 |
| Lacquer Rating (deposit) | | none | none | none | none | medium | — | dark |
| n-pentane insoluble, mass % | | 0.00 | 0.00 | 0.00 | 0.00 | 0.21 | — | 0.45 |

(1) OCP: same as the one shown in Table 3
(2) PMA: same as the one shown in Table 3
(3) Ashless dispersant A: same as the one shown in Table 4
(4) Ashless dispersant B: same as the one shown in Table 4
(5) Phosphorus-containing additive A: same as the one shown in Table 4
(6) Oxidation inhibitor A: same as the one shown in Table 4

As apparent from the results in Table 11, the blend of (C) an ashless dispersant and (D) a phosphorus-containing additive in combination makes it possible to provide anti-abrasion characteristics, oxidation stability, and detergency which are necessary for a traction drive fluid.

Fluids 54–59 were prepared by blending Fluid 41 with (B) a viscosity index improver, (C) an ashless dispersant, (D) a phosphorus-containing additive, (E) a friction modifier, and (F) a metallic detergent, in accordance with the formulation shown in Table 12. The dependence of friction coefficient on slipping speed of each Fluids 54–59 and Fluids 41 and 47 was measured using a low velocity slip testing machine in accordance with JASO M349-95 "Automatic transmission fluid-determination of shudder inhibition capability" under the same conditions as the above. The dependence of friction coefficient on slipping speed was expressed by the value of ($\mu$(1 rpm)/$\mu$(50 rpm). If the value exceeds 1, the dependence was graded as positive gradient. If the value is less than 1, the dependence was graded as negative gradient.

TABLE 12

| Composition (mass %) | | Fluid 54 | Fluid 55 | Fluid 56 | Fluid 57 | Fluid 58 | Fluid 59 | Fluid 41 | Fluid 47 |
|---|---|---|---|---|---|---|---|---|---|
| Base oil | Fluid 41 | 99.85 | 99.85 | 99.5 | 99.5 | 93.5 | 88.3 | 100 | 97.35 |
| Component B | OCP | — | — | — | — | 3.2 | — | — | — |
| | PMA | — | — | — | — | — | 8.4 | — | — |
| Component C | Ashless Dispersant A | — | — | — | — | 1.5 | 1.5 | — | 1.5 |
| | Ashless Dispersant B | — | — | — | — | 1.0 | 1.0 | — | 1.0 |
| Component D | Phosphorus-containing Additive A | — | — | — | — | 0.15 | 0.15 | — | 0.15 |
| Component E | Friction Modifier C | 0.15 | — | — | — | 0.15 | 0.15 | — | — |
| | Friction Modifier B | — | 0.15 | — | — | — | — | — | — |
| Component F | Mg Sulfonate A | — | — | 0.5 | — | — | — | — | — |
| | Ca Sulfonate B | — | — | — | 0.5 | 0.5 | 0.5 | — | — |

TABLE 12-continued

| Composition (mass %) | Fluid 54 | Fluid 55 | Fluid 56 | Fluid 57 | Fluid 58 | Fluid 59 | Fluid 41 | Fluid 47 |
|---|---|---|---|---|---|---|---|---|
| Low Velocity Slippage Test $\mu$(1 rpm)/$\mu$(50 rpm) | 0.92 Positive Gradient | 0.93 Positive Gradient | 0.97 Positive Gradient | 0.96 Positive Gradient | 0.86 Positive Gradient | 0.87 Positive Gradient | 1.63 Negative Gradient | 1.35 Negative Gradient |

(1) OCP: same as the one shown in Table 3
(2) PMA: same as the one shown in Table 3
(3) Ashless dispersant A: same as the one shown in Table 4
(4) Ashless dispersant B: same as the one shown in Table 4
(5) Phosphorus-containing additive A: same as the one shown in Table 4
(6) Friction modifier C: ethoxylatedamine represented by the formula

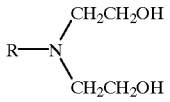

(R: isostearyl group)
(7) Friction modifier B: same as the one shown in Table 6
(8) Mg sulfonate A: same as the one shown in Table 6
(9) Ca sulfonate A: same as the one shown in Table 6

As apparent from the results in Table 12, the blend of (E) a friction modifier and/or (F) a metallic detergent with a traction drive fluid makes it possible to optimize friction characteristics for a wet clutch such as a variable-speed clutch and a slip-lock-up clutch.

Example 3

Fluid 60 according to the present invention was prepared by the following procedures.

(Fluid 60)

1,420 g (about 12.0 mole) of indane were charged into a 3 L 4-necked flask and cooled to below 5° C. in an ice bath, followed by the addition of 1240 g (about 12.0 moles) of 95 concentrated sulfuric acid. The mixture was further cooled until the interior of the reaction vessel was cooled to below 5° C., followed by the addition of 685 g (about 6.0 moles) of 2-methylcyclohexanol in droplets over 5 hours. Thereafter, the reaction was continued for 2 hours. The reaction solution was transferred into a 5 L separatory funnel to separate the sulfuric acid phase. 1 L of pure water was then added to the solution 5 times so as to dissolve and remove the by-products and other impurities. The resulting solution was made alkali with 1% aqueous solution of sodium hydroxide, followed by the addition of 1 L of water until the aqueous phase was made neutral. After the separation of the aqueous phase, the remaining was dehydrated with sodium sulfate anhydride, followed by removal of the light fractions at a temperature of 100° C. and pressure of 0.4 kPa (3 mmHg). The resulting product was subjected to vacuum distillation thereby obtaining 800 g of a fraction having a boiling point of 133.1 to 134.4° C. at a pressure of 266 Pa (2 mmHg). The fraction was charged into a 2 L autoclave, followed by the addition of 8 g of a nickel-based hydrogenating catalyst. The reaction was carried out at a temperature of 150° C. and at a maximum pressure of $6.86\times10^6$ Pa (70 kg/cm$^2$) until the absorption of hydrogen did not occurred. Thereafter, the catalyst was removed thereby obtaining about 865 g of Fluid 60 which is a mixture of a compound represented by formula (61) and a compound represented by formula (62). The ratio of the compound of formula (61) to the compound of formula (62) was 98:2 percent by mass.

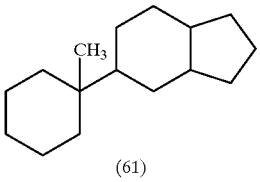

(61)

+

-continued

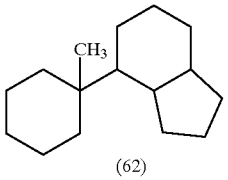

(62)

The traction coefficient and Brookfiled viscosity at −30° C., of Fluids 60 and isobutene oligomer (Comparative fluid 2) were measured and the results are shown in Table 13.

TABLE 13

| Sample | Traction Coefficient | Brookfield Viscosity @ −30° C. mPa · s |
|---|---|---|
| Fluid 60 | 0.091 | 3,200 |
| Comparative Fluid 2 | 0.071 | 4,500 |

Next, various mixed fluids were prepared using Fluid 60, Comparative fluid 2, and 2-methyl-2,4-dicyclohexylpentane (Comparative Fluid 3), in accordance with the formulation shown in Table 14. The traction coefficient and Brookfield viscosity at −30° C. of each of the resulting fluids were measured. The results were also shown in Table 14.

TABLE 14

| | Composition (mass %) | | | | Brookfield |
|---|---|---|---|---|---|
| | Fluid 60 | Comparative Fluid-2 | Comparative Fluid-3 | Traction Coefficient | Viscosity @ −30° C. mPa · s |
| Comparative Fluid 3 | — | — | 100 | 0.099 | 30,000 |
| Fluid 61 | 10 | — | 90 | 0.098 | 23,000 |
| Comparative Fluid 5 | — | 10 | 90 | 0.096 | 24,000 |
| Fluid 62 | 50 | — | 50 | 0.095 | 9,000 |
| Comparative Fluid 6 | — | 50 | 50 | 0.085 | 11,000 |

Fluid 60 according to the present invention can be significantly improved in low temperature viscosity characteristics but not almost changed in traction coefficient by being blended with 2-methyl-2,4-dicyclohexylpentane (Comparative fluid 3) which is a conventional traction fluid.

Fluids 63–65 were prepared by mixing Fluid 60 with polymethacrylate (PMA), polyisobutylene (PIB), and a hydrogenated product of a copolymer of ethylene-α-olefin (OCP) as viscosity index improvers (B). Fluids 63–65 and Fluid 60 were measured in kinematic viscosity at 100° C. and low temperature viscosity at 30° C. (BF viscosity) and traction coefficient. The results were shown in Table 15.

TABLE 15

| | Composition (mass %) | | | | Kinematic Viscosity @ 100° C. | Brookfield Viscosity @ −30° C. | Traction |
|---|---|---|---|---|---|---|---|
| | | Component B | | | | | |
| | Fluid 60 | PMA | PIB | OCP | $mm^2/s$ | mPa · s | Coefficient |
| Fluid 60 | 100 | — | — | — | 3.0 | 3,200 | 0.091 |
| Fluid 63 | 94.0 | 6.0 | — | — | 5.0 | 4,400 | 0.086 |
| Fluid 64 | 94.6 | — | 5.4 | — | 5.0 | 7,800 | 0.090 |
| Fluid 65 | 97.7 | — | — | 2.3 | 5.0 | 5,100 | 0.089 |

(1) OCP: same as the one shown in Table 3
(2) PIB: same as the one shown in Table 3
(3) PMA: same as the one shown in Table 3

As apparent from the results in Table 15, the high temperature viscosity can be significantly enhanced by blending (B) a viscosity index improver, with the traction coefficient and low temperature viscosity characteristics almost unchanged.

Fluids 66–72 were prepared by mixing Fluid 60 with (B) a viscosity index improver, (C) an ashless dispersant, and (D) a phosphorus-containing additive in accordance with the formulation shown in Table 16. Fluids 66–72 were evaluated in anti-wear characteristics and oxidation stability. The results were also shown in Table 16.

TABLE 16

| Composition (mass %) | | Fluid 66 | Fluid 67 | Fluid 68 | Fluid 69 | Fluid 70 | Fluid 71 | Fluid 72 |
|---|---|---|---|---|---|---|---|---|
| Base Oil | Fluid 60 | 97.35 | 97.35 | 94.55 | 90.85 | 99.5 | 97.0 | 99.35 |
| Component B | OCP | — | — | 2.3 | — | — | — | — |
| | PMA | — | — | — | 6.0 | — | — | — |
| Component C | Ashless Dispersant A | 1.5 | — | 1.5 | 1.5 | — | 1.5 | — |
| | Ashless Dispersant B | 1.0 | 2.5 | 1.0 | 1.0 | — | 1.0 | — |
| Component D | Phosphorus-Containing Additive A | 0.15 | 0.15 | 0.15 | 0.15 | — | — | 0.15 |
| Other | Oxidation Inhibitor A | — | — | 0.5 | 0.5 | 0.5 | 0.5 | 0.5 |
| Shell Four Ball Test Wear-scar Size, mm | | — | — | 0.42 | 0.43 | — | 1.52 | 0.51 |
| Oxidation Stability Test | | | | | | | | |
| Total Acid Value Increase, mg KOH/g | | 0.42 | 0.45 | 0.51 | 0.53 | 0.49 | — | 1.56 |
| Lacquer Rating (deposit) | | none | none | none | none | medium | — | dark |
| n-pentane insoluble, mass % | | 0.00 | 0.00 | 0.00 | 0.00 | 0.19 | — | 0.61 |

(1) OCP: same as the one shown in Table 3
(2) PMA: same as the one shown in Table 3
(3) Ashless dispersant A: same as the one shown in Table 4
(4) Ashless dispersant B: same as the one shown in Table 4
(5) Phosphorus-containing additive A: same as the one shown in Table 4
(6) Oxidation inhibitor A: the same as the one shown in Table 4

As apparent from the results in Table 16, the blend of (C) an ashless dispersant and (D) a phosphorus-containing additive in combination makes it possible to provide anti-wear characteristics, oxidation stability, and detergency which are necessary for a traction drive fluid.

Fluids 73–78 were prepared by blending Fluid 60 with (B) a viscosity index improver, (C) an ashless dispersant, (D) a phosphorus-containing additive, (E) a friction modifier, and (F) a metallic detergent, in accordance with the formulation shown in Table 17. The dependence of friction coefficient on slipping speed of each Fluids 73–78 and Fluids 60 and 66 was measured using a low velocity slip testing machine in accordance with JASO M349-95 "Automatic transmission fluid-determination of shudder inhibition capability" under the same conditions as the above. The dependence of friction coefficient on slipping speed was expressed by the value of ($\mu$(1 rpm)/$\mu$(50 rpm). If the value exceeds 1, the dependence was graded as positive gradient. If the value is less than 1, the dependence was graded as negative gradient.

TABLE 17

| Composition (mass %) | | Fluid 73 | Fluid 74 | Fluid 75 | Fluid 76 | Fluid 77 | Fluid 78 | Fluid 60 | Fluid 66 |
|---|---|---|---|---|---|---|---|---|---|
| Base oil | Fluid 60 | 99.85 | 99.85 | 99.5 | 99.5 | 93.9 | 90.2 | 100 | 97.35 |
| Component B | OCP | — | — | — | — | 2.3 | — | — | — |
| | PMA | — | — | — | — | — | 6.0 | — | — |
| Component C | Ashless Dispersant A | — | — | — | — | 1.5 | 1.5 | — | 1.5 |
| | Ashless Dispersant B | — | — | — | — | 1.0 | 1.0 | — | 1.0 |
| Component D | Phosphorus-containing Additive A | — | — | — | — | 0.15 | 0.15 | — | 0.15 |
| Component E | Friction Modifier A | 0.15 | — | — | — | 0.15 | 0.15 | — | — |
| | Friction Modifier B | — | 0.15 | — | — | — | — | — | — |
| Component F | Mg Sulfonate A | — | — | 0.5 | — | — | — | — | — |
| | Ca Sulfonate B | — | — | — | 0.5 | 0.5 | 0.5 | — | — |
| Other | Oxidation Inhibitor A | — | — | — | — | 0.5 | 0.5 | — | — |
| Low Velocity Slippage Test | | 0.82 Positive Gradient | 0.89 Positive Gradient | 0.95 Positive Gradient | 0.93 Positive Gradient | 0.89 Positive Gradient | 0.9 Positive Gradient | 1.49 Negative Gradient | 1.23 Negative Gradient |
| $\mu$(1 rpm)/$\mu$(50 rpm) | | | | | | | | | |

(1) OCP: same as the one shown in Table 3
(2) PMA: same as the one shown in Table 3
(3) Ashless dispersant A: same as the one shown in Table 4
(4) Ashless dispersant B: same as the one shown in Table 4
(5) Phosphorus-containing additive A: same as the one shown in Table 4
(6) Friction modifier C: same as the one shown in Table 6
(7) Friction modifier B: same as the one shown in Table 6
(8) Mg sulfonate A: same as the one shown in Table 6
(9) Ca sulfonate A: same as the one shown in Table 6

As apparent from the results in Table 17, the blend of (E) a friction modifier and/or (F) a metallic detergent with a traction drive fluid makes it possible to optimize friction characteristics for a wet clutch such as a variable-speed clutch and a slip-lock-up clutch.

We claim:

1. A traction drive fluid comprising one or more naphthenic compounds selected from the group consisting of those represented by formula (1):

(1)

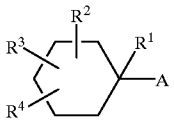

wherein $R^1$ is an alkyl group having 1 to 8 carbon atoms, $R^2$ through $R^4$ are each independently hydrogen or an alkyl group having 1 to 8 carbon atoms, and A is a group selected from the group consisting of (i) a naphthenic hydrocarbon group represented by a formula selected from the group consisting of formulae (8), (12) and (13):

(8)

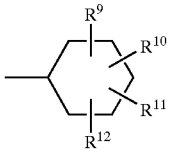

-continued (12)

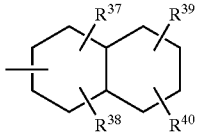

(13)

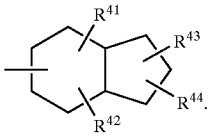

wherein $R^9$ through $R^{12}$ and $R^{37}$ through $R^{44}$ are each independently hydrogen or an alkyl group having 1 to 8 carbon atoms; and (ii) a saturated polycyclic hydrocarbon group represented by formula (14) or (15):

(14)

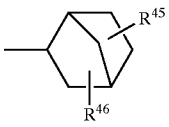

-continued (15)

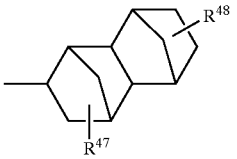

wherein $R^{45}$ through $R^{48}$ are each independently hydrogen or an alkyl group having 1 to 8 carbon atoms.

2. The traction drive fluid according to claim 1, comprising two or more naphthenic compounds selected from the group consisting of those represented by formula (1).

3. The traction drive fluid according to claim 1, further comprising at least one member selected from the group consisting of a mineral oil and a synthetic oil having a molecular weight of 150 to 800.

4. The traction drive fluid according to claim 1, further comprising a viscosity index improver.

5. The traction drive fluid according to claim 4, wherein the viscosity index improver is selected from the group consisting of an ethylene-α-olefin copolymer having a molecular weight from 800 to 150,000 and a hydride thereof.

6. The traction drive fluid according to claim 1, further comprising an ashless dispersant and a phosphorus-containing additive.

7. The traction drive fluid according to claim 1, further comprising a friction modifier having in its molecules at least one alkyl or alkenyl group having 6 to 30 carbon atoms but no hydrocarbon group having more than 30 carbon atoms.

8. The traction drive fluid according to claim 1, further comprising a metallic detergent having a total base value of 20 to 450 mg KOH/g.

* * * * *